US009284168B2

(12) United States Patent
Mau et al.

(10) Patent No.: US 9,284,168 B2
(45) Date of Patent: Mar. 15, 2016

(54) GUYLESS SERVICE RIG WITH SIDE-MOUNTED, PIVOTALLY DEPLOYABLE REAR OUTRIGGERS

(75) Inventors: Robert Eugene Mau, Kenmare, ND (US); Thomas Edwin Mau, Kenmare, ND (US); Gregory Alan Wiedmer, Kenmare, ND (US)

(73) Assignee: MW INDUSTRIES, INC., Kenmare, ND (US)

( * ) Notice: Subject to any disclaimer, the term of this patent is extended or adjusted under 35 U.S.C. 154(b) by 333 days.

(21) Appl. No.: 12/886,177

(22) Filed: Sep. 20, 2010

(65) Prior Publication Data

US 2011/0079568 A1 Apr. 7, 2011

Related U.S. Application Data

(60) Provisional application No. 61/274,126, filed on Oct. 1, 2009.

(51) Int. Cl.
*B66C 23/80* (2006.01)
*B66C 23/78* (2006.01)

(52) U.S. Cl.
CPC ..... *B66C 23/80* (2013.01); *B66C 23/78* (2013.01)

(58) Field of Classification Search
CPC ..... B66C 23/78; B66C 23/48; B66C 23/80; B66C 23/62; E02F 9/085
USPC ..... 212/301–306
See application file for complete search history.

(56) References Cited

U.S. PATENT DOCUMENTS

| | | | | | |
|---|---|---|---|---|---|
| 2,200,075 | A | * | 5/1940 | Caldwell | 173/44 |
| 2,300,763 | A | * | 11/1942 | Athy | 52/118 |
| 2,703,634 | A | * | 3/1955 | Lee | 52/115 |
| 2,742,260 | A | * | 4/1956 | Patterson | 254/399 |
| 2,948,511 | A | * | 8/1960 | Wilson | 254/328 |
| 2,992,016 | A | * | 7/1961 | Pilch | 414/694 |
| 2,993,570 | A | * | 7/1961 | Bender | 52/118 |
| 3,089,550 | A | * | 5/1963 | Watson | 173/147 |
| 3,101,816 | A | * | 8/1963 | Fox | 52/118 |
| 3,181,658 | A | * | 5/1965 | Bender | 52/116 |
| 3,340,938 | A | * | 9/1967 | Wilson | 173/28 |

(Continued)

FOREIGN PATENT DOCUMENTS

| | | | |
|---|---|---|---|
| GB | 888531 | 1/1962 | |
| WO | WO 2005092775 A1 * | 10/2005 | B66C 23/42 |

OTHER PUBLICATIONS

Web page regarding Irontech Free-Standing Hydraulic Outriggers, [online], [retrieved on May 27, 2009], Retrieved from www.irontechrig.com/pages/outriggers.htm.

*Primary Examiner* — Emmanuel M Marcelo
*Assistant Examiner* — Michael Gallion
(74) *Attorney, Agent, or Firm* — Marsh Fischmann Breyfogle LLP

(57) ABSTRACT

A service or workover rig (50) that does not require guy lines is disclosed. Components of the rig (50) include a carrier (52) and a mast (120) that is movable between transport and deployed positions. Two rear outriggers (160) are pivotally mounted to a bumper (64) of the carrier (52). In their transport position, the rear outriggers (160) are positioned along respective sides (58) of the carrier (52), for instance in cutouts (60) in the bed or decking (56) of the carrier (52). In their deployed position, the rear outriggers (160) extend rearwardly of the carrier (52) and also away from their respective carrier side (58). Each rear outrigger (160) may be in the form of a hollow beam.

18 Claims, 17 Drawing Sheets

(56) References Cited

U.S. PATENT DOCUMENTS

| | | | | | |
|---|---|---|---|---|---|
| 3,638,805 | A * | 2/1972 | Garnier | 212/175 |
| 3,643,815 | A * | 2/1972 | Balogh | 212/175 |
| 3,650,421 | A * | 3/1972 | Miller | 414/543 |
| 3,716,252 | A * | 2/1973 | Johnson | 280/766.1 |
| 3,752,229 | A * | 8/1973 | Pridy | 166/72 |
| 3,792,836 | A * | 2/1974 | Bender | 254/361 |
| 3,843,154 | A * | 10/1974 | Thompson | 280/766.1 |
| 3,856,150 | A * | 12/1974 | Wellman | 212/297 |
| 3,942,593 | A * | 3/1976 | Reeve et al. | 173/186 |
| 3,958,813 | A * | 5/1976 | Carey | 280/755 |
| 3,985,036 | A * | 10/1976 | Decker et al. | 74/96 |
| 4,013,307 | A * | 3/1977 | Dowd et al. | 280/764.1 |
| 4,015,730 | A * | 4/1977 | Symmank | 414/718 |
| 4,027,801 | A * | 6/1977 | Johnston et al. | 212/304 |
| 4,036,508 | A * | 7/1977 | Eddy et al. | 280/492 |
| 4,142,710 | A * | 3/1979 | Okuda | 254/423 |
| 4,267,675 | A * | 5/1981 | Cochran | 52/118 |
| 4,269,395 | A * | 5/1981 | Newman et al. | 254/386 |
| 4,278,140 | A * | 7/1981 | Oswald et al. | 180/6.48 |
| 4,290,495 | A * | 9/1981 | Elliston | 175/85 |
| 4,371,046 | A * | 2/1983 | Read | 175/57 |
| 4,416,344 | A * | 11/1983 | Nakada | 180/8.1 |
| 4,444,536 | A * | 4/1984 | Brown | 414/22.56 |
| 4,454,952 | A * | 6/1984 | McGhie | 212/302 |
| 4,568,035 | A * | 2/1986 | Ruch et al. | 242/390.5 |
| 4,575,976 | A * | 3/1986 | McDermott et al. | 52/118 |
| 4,684,306 | A * | 8/1987 | Brewer et al. | 414/22.68 |
| 5,107,954 | A * | 4/1992 | Fujimoto | 182/2.11 |
| 5,174,389 | A * | 12/1992 | Hansen | 175/52 |
| 5,240,129 | A * | 8/1993 | Schrick et al. | 212/175 |
| 5,387,071 | A * | 2/1995 | Pinkston | 414/563 |
| 5,431,240 | A * | 7/1995 | Merritt | 180/9.42 |
| 5,638,967 | A * | 6/1997 | Heckmann | 212/302 |
| 5,706,960 | A * | 1/1998 | Pitman et al. | 212/304 |
| 5,934,409 | A * | 8/1999 | Citron et al. | 182/18 |
| 6,196,586 | B1 * | 3/2001 | Messenger | 280/763.1 |
| 6,257,619 | B1 * | 7/2001 | Bender et al. | 280/764.1 |
| 6,351,696 | B1 * | 2/2002 | Krasny et al. | 701/50 |
| 6,360,905 | B1 * | 3/2002 | Frommelt et al. | 212/302 |
| 6,516,917 | B1 * | 2/2003 | Mayer et al. | 182/17 |
| 6,634,436 | B1 * | 10/2003 | Desai | 173/1 |
| 7,556,240 | B1 * | 7/2009 | Bauer et al. | 254/294 |
| 7,574,832 | B1 * | 8/2009 | Lieberman | 52/118 |
| 7,788,858 | B1 * | 9/2010 | Ammons | 52/118 |
| 8,316,588 | B2 * | 11/2012 | Cicognani | 52/118 |
| 2003/0001373 | A1 * | 1/2003 | Slater et al. | 280/763.1 |
| 2004/0256344 | A1 * | 12/2004 | Willim | 212/301 |
| 2005/0011560 | A1 * | 1/2005 | Anderson et al. | 137/615 |
| 2007/0193749 | A1 * | 8/2007 | Folk | 166/379 |
| 2007/0221600 | A1 * | 9/2007 | Davis | 212/270 |
| 2008/0169258 | A1 * | 7/2008 | Weisbauer | 212/296 |
| 2009/0008110 | A1 * | 1/2009 | Osadchuk | 173/1 |
| 2009/0167008 | A1 * | 7/2009 | Autenrieth | 280/764.1 |
| 2009/0283163 | A1 * | 11/2009 | Wehner et al. | 137/615 |
| 2010/0320166 | A1 * | 12/2010 | Karp et al. | 212/303 |
| 2011/0062695 | A1 * | 3/2011 | Bergemann et al. | 280/763.1 |
| 2013/0074377 | A1 * | 3/2013 | Colbert | 37/403 |

* cited by examiner

GUYLESS SERVICE RIG WITH SIDE-MOUNTED, PIVOTALLY DEPLOYABLE REAR OUTRIGGERS

CROSS-REFERENCE TO RELATED APPLICATIONS

This patent application claims priority under 35 U.S.C. §119(e) to pending U.S. Provisional Patent Application Ser. No. 61/274,126 that is entitled "GUYLESS SERVICE RIG WITH SIDE-MOUNTED, PIVOTALLY DEPLOYABLE REAR OUTRIGGERS," that was filed on Oct. 1, 2009, and the entire disclosure of which is hereby incorporated by reference in its entirety herein.

FIELD OF THE INVENTION

The present invention generally relates to the field of service or workover rigs and, more particularly, to stabilizing a service/workover rig when its mast is in its deployed or erected position.

BACKGROUND

Two general categories of rigs include drilling rigs and service or workover rigs. Drilling rigs are used to drill wells (e.g., oil, natural gas), while service/workover rigs are used to service or work existing wells for any appropriate reason. Representative servicing or workovers of existing wells includes without limitation replacing one or more components (including downhole components) associated with the well (e.g., tubing, valves, seals, flanges, blowout preventers), directing one or more components into the well for any appropriate purpose (e.g., a tool for opening a downhole blockage), executing one or more well operations (e.g., fracturing, acidizing), or the like.

Both drilling and service/workover rigs typically use a derrick or mast that supports one or more pulleys, one or more block and tackle arrangements, or the like. Various lines, cable, or the like may be directed around one or more of these pulleys/block and tackle arrangements to lift the desired component(s) and/or to lower the desired component(s) as desired/required. These lines or cables are anchored to what is commonly referred to in the art as a drawworks. An appropriate power source (e.g., a right angle drive) rotates one or more drums of the drawworks in one direction to wind the line/cable around one or more drums of the drawworks to lift the desired component(s), while the power source rotates one or more drums of the drawworks in the opposite direction to unwind the line/cable from one or more drums of the drawworks to lower the desired component(s). "Cable" is commonly viewed as being of a heavier grade than "line," and thereby more appropriate for handling heavier components. Cable is commonly associated with a main drum of a drawworks, while line is commonly associated with a sand drum of a drawworks in a service/workover rig. Service or workover rigs typically use a drawworks having both a main drum and a sand drum, while drilling rigs typically only use a main drum.

Many service/workover rigs are incorporated by a truck/tractor for transporting the same from location to location. Moreover, the mast is typically movable between a stowed position (e.g., at least generally horizontal, and including for transportation purposes) and a deployed position (e.g., at least generally vertical, although in practice most masts are disposed at a small angle relative to vertical). In addition to being deployable, the mast should be designed to accommodate the loads that will be experienced during operation of the service/workover rig. The mast or derrick of service/workover rigs oftentimes extends in excess of 90 feet in its fully extended configuration. It should be appreciated that it is desirable to have the mast be sufficiently stable in its extended configuration.

SUMMARY

A first aspect of the present invention is generally directed to a mobile service or workover rig. Components of the service rig include a carrier, a drawworks, a mast, one or more anchoring lines, and first and second rear outriggers. The drawworks is mounted on the carrier and includes at least a main drum. The mast is also mounted on the carrier, includes first and second mast sections that are movably interconnected (e.g., configured to telescope or extend/retract relative to each other), and is movable between a mast transport position and a mast deployed position. The first and second rear outriggers are pivotally connected with the carrier, and are pivotable between an outrigger transport position and an outrigger deployed position. Each of the rear outriggers is positioned along corresponding sides of the carrier in the outrigger transport position, and extends both away from their corresponding carrier side (as well as away from a central longitudinal axis of the service rig/carrier) and rearward of the carrier such that a free end of each of the first and second rear outriggers is positioned rearward of the carrier in the outrigger deployed position. Opposite ends of each anchoring line that is utilized by the service rig are anchored solely to the service rig (e.g., spaced portions thereof).

A second aspect of the present invention is generally directed to a mobile service or workover rig. Components of the service rig include a carrier, a drawworks, a mast, one or more anchoring lines, and first and second rear outriggers that are each in the form of a hollow support beam. The drawworks is mounted on the carrier and includes at least a main drum. The mast is also mounted on the carrier, includes first and second mast sections that are movably interconnected (e.g., configured to telescope or extend/retract relative to each other), and is movable between a mast transport position and a mast deployed position. The first and second rear outriggers are movably connected with a carrier bumper, and are movable between an outrigger transport position and an outrigger deployed position. Each of the rear outriggers is positioned along corresponding sides of the carrier in the outrigger transport position, and extends both away from their corresponding carrier side (as well as away from a central longitudinal axis of the service rig/carrier) and rearward of the carrier bumper such that a free end of each of the first and second rear outriggers is positioned rearward of the carrier bumper in the outrigger deployed position. Opposite ends of each anchoring line that is utilized by the service rig are anchored solely to the service rig (e.g., spaced portions thereof).

A number of feature refinements and additional features are separately applicable to each of the first and second aspects of the present invention. These feature refinements and additional features may be used individually or in any combination. The following discussion is separately applicable to each of the first and aspects of the present invention unless otherwise noted. The carrier may be in the form of a self-propelled device, or alternatively could be in the form of a trailer that is pulled by an appropriate vehicle. A sand drum may also be utilized by the drawworks. The main drum, along with any sand drum, may utilize appropriate cabling or line for performing well-servicing or workover operations of any appropriate kind/type (e.g., where such cables or lines extend from the main drum or sand drum, to one or more sheaves on a crown of the mast, and then back toward the well being serviced to lower/lift one or more components).

The first and second rear outriggers may be coupled with a single structure, for instance the carrier (e.g., its bumper). A single coupling may allow the first rear outrigger to move between its outrigger transport and deployed positions and which may exist between the first rear outrigger and the carrier (e.g., one end of a carrier bumper), and single coupling may allow the second rear outrigger to move between its outrigger transport and deployed positions and which may exist between the second rear outrigger and the carrier (e.g., an opposite end of a carrier bumper). In at least one embodiment, the first and second rear outriggers are not directly coupled with the mast. For instance, there may be a lack of a movable joint of any kind between the mast and the first rear outrigger, and there may be a lack of a movable joint of any kind between the mast and the second rear outrigger.

A bumper may be provided at the rear of carrier. The first and second rear outriggers may be pivotally mounted to this bumper (e.g., on opposite ends thereof), a Y-base may be mounted on this carrier bumper and to which the mast may be movably mounted (e.g., for movement between the mast transport and deployed positions), or both. One or more pivot pins may pivotally connect each rear outrigger to the carrier bumper. Each such pivot pin may be at least substantially vertically disposed when the carrier is at least substantially horizontally disposed (e.g., on flat ground). The spacing between the pivot pin(s) for the first and second rear outriggers may at least substantially define a maximum width of the service rig.

The mast may include a crown. This crown may define an uppermost portion of the mast when the mast is in its deployed or erected position. One or more sheaves may be located at the crown to accommodate cables, lines, or the like that extend from the drawworks (e.g., the main drum, a sand drum) and that may be utilized to lower one or more components toward/into the well, to lift one or more components out of/above the well, or both.

The mast may be of any appropriate size, shape, configuration, and/or type. More than two movable sections could be utilized by the mast, where adjacent mast sections are able to telescope or extend/retract relative to each other. The mast has a length so as to extend at least about 70 feet above the ground on which the service rig is disposed in its fully extended configuration in one embodiment, and so as to extend at least about 90 feet above the ground on which the service rig is disposed in its fully extended configuration in another embodiment.

Having each end of each anchoring line utilized by the service rig being anchored to the service rig itself may be characterized as providing a guyless service rig. For instance, the first and second aspects encompass having no anchoring line extending from the mast to the ground on which the carrier is supported. In one embodiment, one end of first and second anchoring lines is anchored to the first and second rear outriggers, respectively. Although an opposite end of these first and second anchoring lines could be anchored directly to the mast, these opposite ends may be anchored to a racking/tubing board that in turn is supported by the mast at an appropriate location above the ground on which the service rig is disposed.

The first and second rear outriggers may move within a common plane when moving between the outrigger transport position and the outrigger deployed position. Consider the case where the carrier includes a carrier bed or the like on which one or more components may be positioned (e.g., the drawworks). The first and second rear outriggers may move within a plane that is parallel to the carrier bed when moving between the outrigger transport position and the outrigger deployed position. The first and second rear outriggers may also be characterized as moving at least substantially in a horizontal dimension when the carrier is horizontally disposed (e.g., on flat ground) and when moving between the outrigger transport position and the outrigger deployed position. Another characterization is that a reference plane corresponds with the interface between the ground and the tires of the carrier, and that the first and second rear outriggers move at least substantially parallel to this reference plane when moving between the outrigger transport position and the outrigger deployed position.

The first and second rear outriggers may be positioned alongside the carrier in their respective transport positions. Notches may be included along the opposite sides of the carrier (e.g., in the carrier bed or decking) to accommodate the first and second rear outriggers in their transport position. In one embodiment, no portion of the rear outriggers extends above a carrier bed of the carrier. Stated another way, a carrier bed of the carrier may be disposed at a first elevation relative to an underlying support surface for the carrier (e.g., the ground), while an uppermost portion of the rear outriggers may be disposed at this same first elevation or at a lower elevation relative to the underlying support surface. An uppermost portion of each rear outrigger may be parallel with a carrier bed for the carrier (e.g., including at least generally coplanar therewith).

Each rear outrigger may be in the form of a hollow support beam. The rear outriggers may also be characterized as including a fully enclosed space. For instance, each rear outrigger may be defined by an upper or top wall, a lower or bottom wall that is spaced from this upper wall, and a pair of side walls that each extend between the upper and lower walls to define a hollow structure and/or an enclosed space. In one embodiment, the upper and lower walls of each rear outrigger are disposed in non-parallel relation. For instance, the spacing between the upper and lower walls of each rear outrigger may become progressively smaller proceeding along the length of the rear outrigger in the direction of a free end thereof (e.g., the free end being opposite of that end which may be movably coupled with the carrier). In one embodiment, the upper wall of each rear outrigger is at least generally horizontally disposed when a carrier bed of the carrier is also in a horizontal orientation (e.g., when on flat ground), while the lower wall of each rear outrigger is disposed at an angle relative to horizontal. The lower wall of each rear outrigger may be characterized as extending at least generally toward its corresponding upper wall proceeding in the direction of a free end of the rear outrigger.

First and second rear outrigger braces may be associated with the first and second rear outriggers, respectively. These rear outrigger braces may be detachably coupled with their corresponding rear outrigger (e.g., movable between attached and detached conditions or states). In one embodiment, a free end of the first rear outrigger brace is anchored (e.g., detachably coupled) to the first rear outrigger at a location that is at least generally midway between its two opposite ends, while a free end of the second rear outrigger brace is anchored (e.g., detachably coupled) to the second rear outrigger at a location that is at least generally midway between its two opposite ends.

The first and second rear outrigger braces may be movable between a first position (where they are not coupled with their corresponding rear outrigger) and a second position (where they may be coupled with their corresponding rear outrigger, for instance by a locking pin or the like). The second position for the rear outrigger braces may be used to at least substantially lock or fix the position of their corresponding rear outrigger relative to the carrier.

Each rear outrigger and its corresponding outrigger brace may be independently movable. Movement of the first outrigger may not require or precipitate any movement of the first rear outrigger brace, and/or vice versa. Similarly, movement of the second outrigger may not require or precipitate any movement of the second rear outrigger brace, and/or vice versa. Stated another way, movement of the first rear outrigger may not be responsive to a movement of the first rear outrigger brace, and/or vice versa. Movement of the second rear outrigger may not be responsive to a movement of the second rear outrigger brace, and/or vice versa.

The rear outriggers and their corresponding outrigger brace may move in different dimensions between their respective transport/stowed and deployed/extended positions. The first rear outrigger brace may move within a plane (when moving between its transport/stowed position and its deployed position) that is at least generally orthogonal to the plane in which the first rear outrigger moves in changing between its transport and deployed positions. Similarly, the second rear outrigger brace may move within a plane (when moving between its transport/stowed position and its deployed position) that is at least generally orthogonal to the plane in which the second rear outrigger moves in changing between its transport and deployed positions.

Consider the case where the carrier (e.g., its carrier bed) is supported in a horizontal orientation (e.g., on flat ground). The first and second rear outrigger braces may be movable from an at least substantially vertical position (e.g., a corresponding transport position) to an at least generally horizontal position (e.g., a corresponding deployed position) where they may then be coupled with their corresponding rear outrigger when properly deployed. The entirety of the first and second rear outriggers may at all times be at least substantially horizontally disposed, including in both in their respective transport positions and in their respective deployed positions.

The first rear outrigger may be pivotally connected with a first end of a carrier bumper, and the second rear outrigger may be pivotally connected with an opposite second end of the carrier bumper. First and second end sections of the carrier bumper may each extend in a rearward direction from an intermediate bumper section that extends between the first and second end sections, including where the pivotal connection with the first and second rear outriggers exists within the noted first and second end sections of the carrier bumper, respectively. Stated another way, the noted first and second end sections of the carrier bumper may each extend both away from adjacent portions of the intermediate bumper section (as well as away from a central longitudinal axis of the service rig/carrier) and rearwardly from the intermediate bumper section. In one embodiment, the carrier bumper may be characterized as being at least generally arcuately-shaped in a top view, where a cavity defined by this arcuate configuration opens or projects in a rearward direction.

Each of the above-noted first and second rear outrigger braces may be pivotally or movably connected with a carrier bumper at a location that is between opposing ends of the carrier bumper, at a location that is between the pivotal coupling of the carrier bumper to the first and second rear outriggers, or both. The first and second rear outrigger braces may also be characterized as being located within a space defined by the first and second rear outriggers being in their deployed positions (e.g., the first and second rear outrigger braces may be located within the included angle between the first and second rear outriggers in their respective deployed positions, where this included angle may be that angle between the first and second rear outriggers in their respective deployed positions that is less than 180°). Although the first and second rear outrigger braces could be directly movably coupled with the carrier bumper, the first and second rear outrigger braces could be movably coupled with an appropriate frame that is mounted to and extends rearwardly from the carrier bumper.

Any feature of any other various aspects of the present invention that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a mobile service rig includes "a rear outrigger" alone does not mean that the mobile service rig includes only a single rear outrigger). Any failure to use phrases such as "at least one" also does not limit the corresponding feature to the singular (e.g., indicating that a mobile service rig includes "a rear outrigger" alone does not mean that the mobile service rig includes only a single rear outrigger). Use of the phrase "at least generally" or the like in relation to a particular feature encompasses the corresponding characteristic and insubstantial variations thereof (e.g., indicating that an entirety of a rear outrigger is at least generally horizontally disposed/extending also encompasses the entirety of the rear outrigger being horizontally disposed/extending). Finally, a reference of a feature in conjunction with the phrase "in one embodiment" does not limit the use of the feature to a single embodiment.

DETAILED DESCRIPTION

Figure 1:
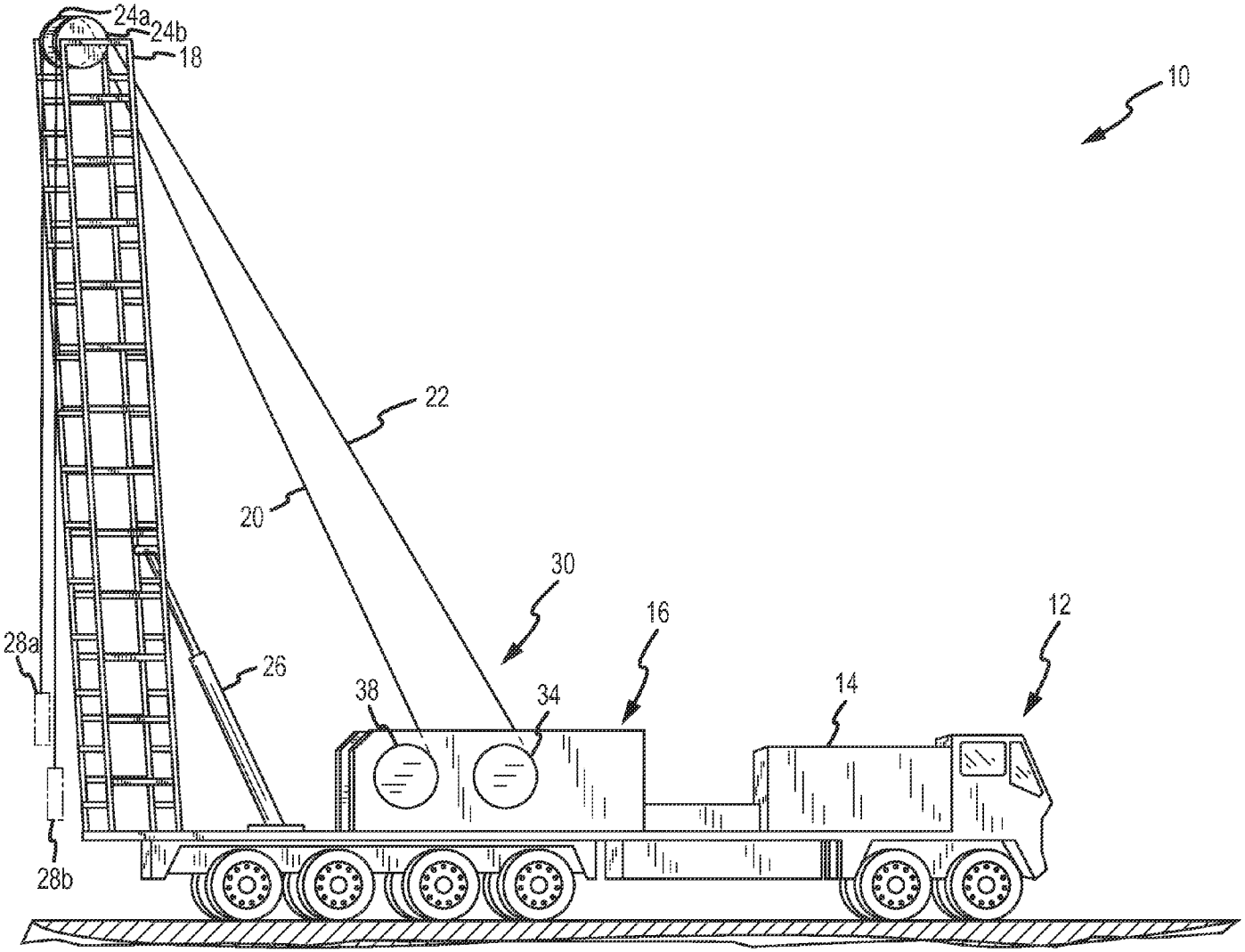
FIG. 1 is a schematic representation of a service or workover rig with its mast being in a deployed position.

FIG. 1 schematically illustrates a basic configuration of a service or workover rig 10. The workover rig 10 is incorporated on an appropriate carrier 12 on which a collapsible derrick or mast 18 is mounted. The mast 18 may be of any appropriate size, shape, and/or configuration. A derrick lift or raising ram 26 of any appropriate size, shape, configuration, and/or type (e.g., one or more hydraulic cylinders) may be used to both raise the mast 18 to the position illustrated in FIG. 1, and to lower the mast 18 back into a transport position on the carrier 12 (not shown, but where the derrick 18 is in an at least generally prone or horizontal position).

The workover rig 10 further includes a drawworks 30 having both a main drum 38 and a sand drum 34. A cable 20 is typically associated with the main drum 38, while a wire line 22 is typically associated with the sand drum 34 (e.g., the cable 20 generally being more robust or stronger than the wire line 22, and thereby accommodating a higher or heavier load). Each of the cable 20 and wire line 22 may be of any appropriate size, shape, configuration, and/or type (each being of an at least generally elongated configuration and sufficiently flexible so as to be able to wrap around the associated main drum 38 or sand drum 34). The cable 20 is anchored to the main drum 38 and extends through a crown sheave 24*a* on the mast 18 (and typically through one or more other sheaves on the derrick 18—not shown), while the wire line 22 is anchored to the sand drum 34 and extends through another crown sheave 24*b* on the mast 18. The crown sheaves 24*a*, 24*b* are only schematically illustrated in FIG. 1. Each of the crown sheave 24*a* and the crown sheave 24*b* may include one or more pulleys, one or more block and tackle arrangements, or both, and each component of each crown sheave 24*a*, 24*b* may be disposed at one or more locations on the derrick 18 and further disposed in any appropriate arrangement.

A component 28*a* is schematically illustrated in FIG. 1 as being suspended from the cable 20 "downstream" of the associated crown sheave(s) 24*a*, while a component 28*b* is schematically illustrated in FIG. 1 as being suspended from the wire line 22 "downstream" of the associated crown sheave(s) 24*b*. Typically, only one of the cable 20 and wire line 22 will be used at any one time (i.e., the other will be appropriately secured out of the way, for instance "tied" to the mast 18). Each of the components 28*a*, 28*b* may be of any appropriate size, shape, configuration, and/or type. The component 28*a* will typically be one that is used by the well that is being serviced by the workover rig 10 (e.g., a well-head; pipe; rod), while the component 28*b* will typically be a test instrument(s), cleaning tool(s), or the like that is directed into the well hole during servicing of the well.

The drawworks 30 is used to raise and lower the component 28*a* via the cable 20 and rotation of the main drum 38, while the drawworks 30 is used to raise and lower the component 28*b* via the wire line 22 and rotation of the sand drum 34. In this regard and for the illustrated embodiment, an engine/transmission 14 (only schematically illustrated) of the carrier 12 is also used to operate a right angle drive 16 (only schematically illustrated), which in turn is used to power the drawworks 30 (e.g., to rotate the sand drum 34, and which may also then rotate the main drum 38).

One embodiment of what may be characterized as a guyless service or workover rig with side-mounted, pivotally-deployable rear outriggers is illustrated in FIGS. 2A-D and is identified by reference numeral 50. The workover rig 50 includes a carrier 52 and a mast 120 that is movably interconnected with and supported by the carrier 52. The mast 120 is movable between a transport position (e.g., FIG. 2A, and where the mast 120 is in a prone or an at least generally horizontal position) and a deployed position (e.g., FIGS. 2B-2D, and where the mast 120 is in an upstanding or an at least generally vertical position, although it will typically be disposed at a small angle from vertical). The workover rig 50 further includes a pair of rear outriggers 160 that stabilizes the workover rig 58 when the mast 120 is in its upstanding or deployed position in such a manner so as to alleviate the need for any guy lines wires to extend from the mast 120 to the ground. It can take two or three hours to stabilize a deployed mast of a service rig with guy lines. Servicing a pump with a service rig can be a two or three hour job. Therefore and in this instance, merely anchoring the mast of the service rig with guy lines can account for at least about 50% of the time that the service rig is at a well site. Eliminating guy lines from a service rig therefore saves a significant amount of time.

The illustrated carrier 52 is in the form of a self-propelled vehicle (e.g., including a cab 54 for a driver and possibly other personnel), although such could be implemented in a trailer configuration or the like. A modified cab 54' is shown in FIG. 2C, and thereby both the service rig 50' and carrier 52' are identified by a "single prime" designation (the cab 54' being part of the carrier 52', and the carrier 52' being part of the service rig 50'). A carrier bed or decking 56 accommodates various components used in service/workover operations. For instance, a Y-base 100 is installed over a bumper 64 on the rear end 62*b* of the carrier 52. A pair of pivotal connections 102 is provided between the Y-base 100 and the mast 120 to allow the mast 120 to move between its transport position and deployed position. In this regard, a raising ram 110 (or any other appropriate actuating device or combination of devices) is supported by the carrier bed 56 and engages the mast 120 to move the same from its transport position to its deployed position. The raising ram 110 may also be utilized in moving the mast 120 from its deployed position to its transport position (e.g., by providing for a controlled descent of the mast 120 into its transport position).

The mast 120 may be used to store components for/during well servicing operations. For instance, the mast 120 may include a rod basket 130 (e.g. for storing rods or the like), a racking/tubing board 128 (e.g., for storing pipe that has been withdrawn from a well), or both. The mast 120 may be utilized to direct components into and remove components from a well via a levering action. What is commonly referred to in the art as a drawworks 80 (e.g., in accordance with the above-discussed drawworks 30) facilitates such functions. The drawworks 80 is mounted on the carried bed 56 and may include both a main drum 82 and a sand drum 84. The discussion presented above with regard to the drawworks 30, main drum 38, and sand drum 34 is equally applicable to the corresponding components of the workover rig 50. Also, the drawworks 80 for the service rig 50 may be in accordance with the drawworks addressed by U.S. Pat. No. 7,556,240 that is entitled "RIG DRAWWORKS," that is commonly assigned, and the entire disclosure of which is incorporated by reference in its entirety herein. In any case, a cable 86 may be wound around the main drum 82, may extend from the main drum 82 up to one or more sheaves 134 on a crown 132 of the mast 120, and may then extend back down toward the well head when the mast 120 is in its deployed position. The main drum 82 may be rotated in one direction to let more cable 86 out (e.g., to lower a component into the well, for instance by unwinding the cable 86 from the main drum 82), and may be rotated in the opposite direction to lift a component out of a well, for instance by winding the cable 86 onto/around the main drum 82).

The mast 120 may be of any appropriate size, shape, configuration, and/or type. For instance, the mast 120 may include two or more sections that telescope relative to an adjacent section to allow the mast 120 to be of one length for transport and to be of an increased length for well servicing operations. In the illustrated embodiment, the mast 120 includes what is commonly referred to as a mid mast, section, or leg 122 (although it may in fact be a lower section or leg of the mast 120) and an upper mast, section or leg 124 that are able to slide relative to each other (e.g., in telescoping relation) to move between a fully retracted and fully extended position. A scoping ram 126 (or any other appropriate device or combination of devices) may be used to extend the upper mast 124 relative to the mid mast 122, and furthermore may at least assist in the retraction of the upper mast 124 relative to the mid mast 122. The mast 120 has a length so as to extend at least about 70 feet in one embodiment, and at least about 90 feet in another embodiment (e.g. about 96 feet), above the ground on which the service rig 50 is disposed and with the mast 120 being in its fully extended position.

Figure 2A:
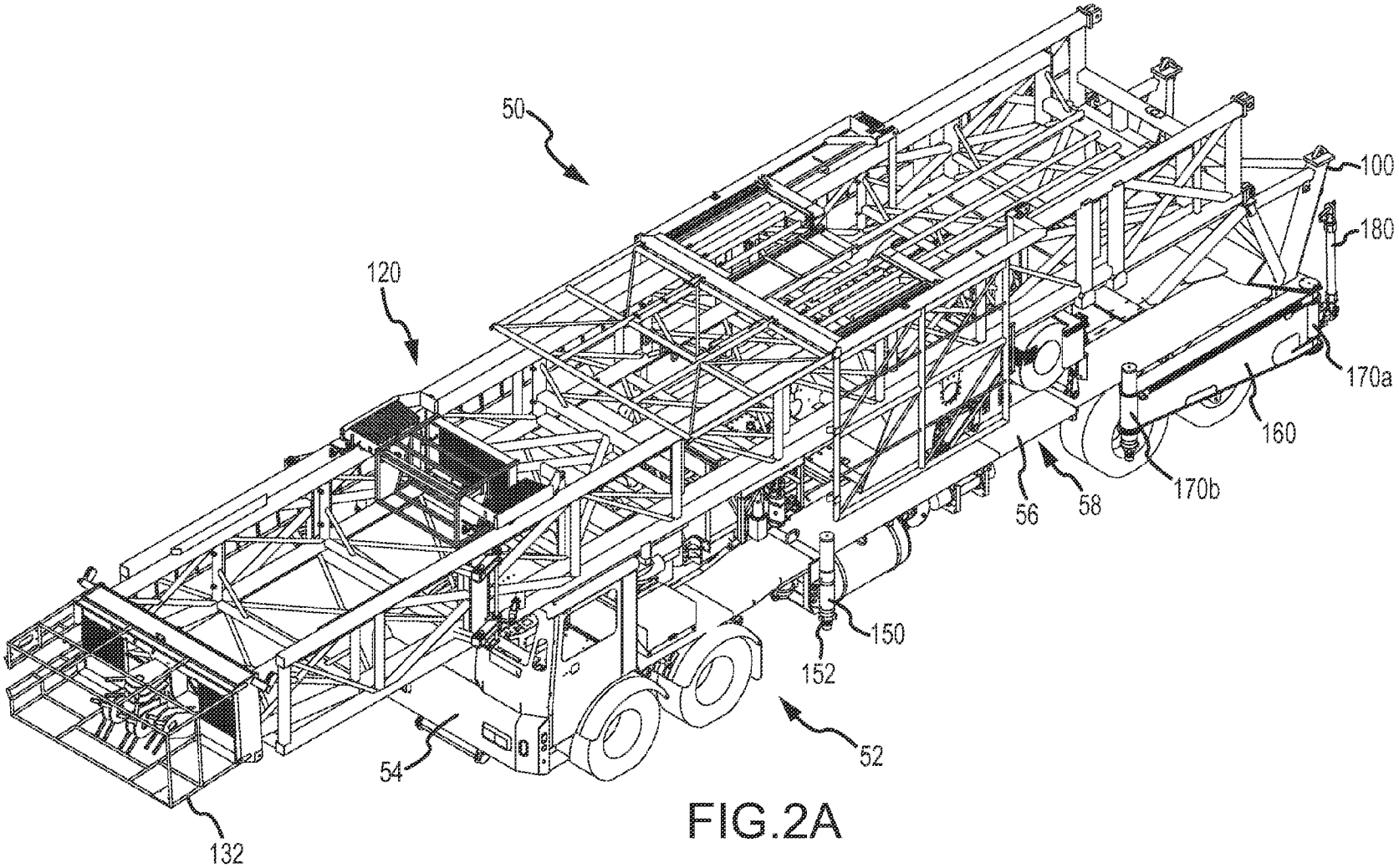
FIG. 2A is a front, perspective view of one embodiment of a guyless service or workover rig, where its mast and rear outriggers are each in a transport position.
Figure 2B:
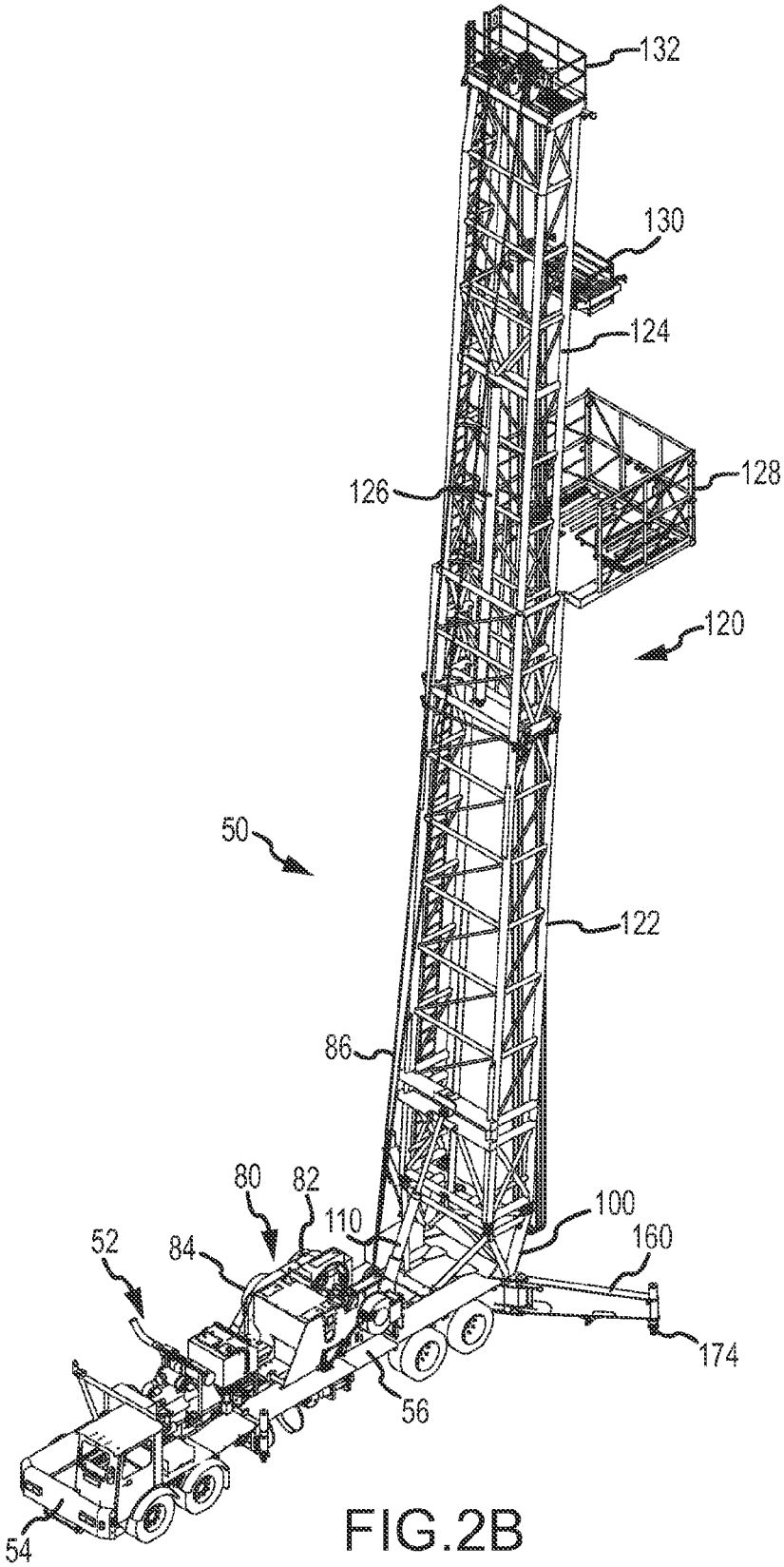
FIG. 2B is a front, perspective view of the guyless service rig of FIG. 2A, where its mast and rear outriggers are each in their respective deployed positions.
Figure 2C:
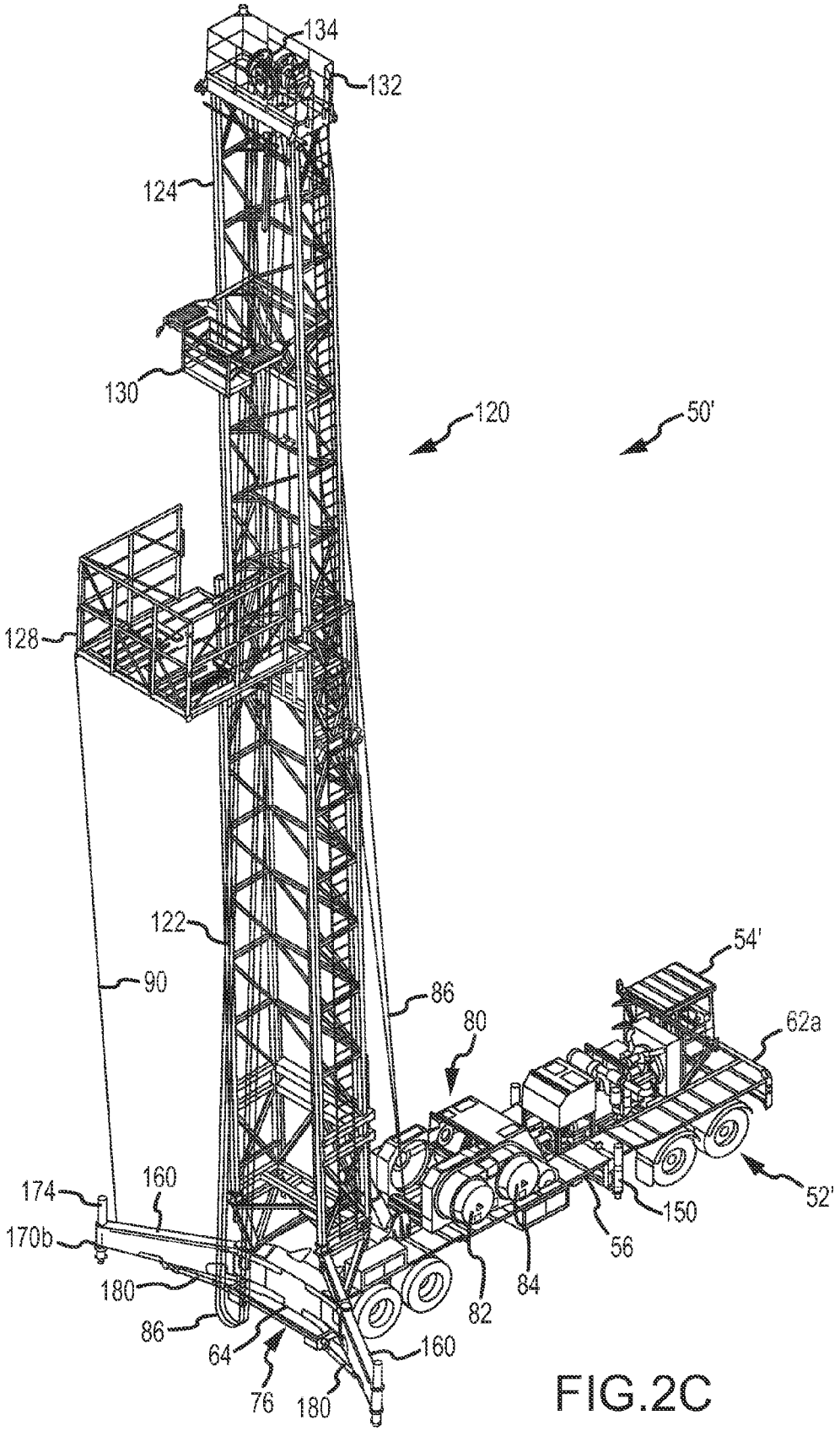
FIG. 2C is a rear, perspective view of the guyless service rig of FIG. 2A with a modified cab for the carrier, where its mast and rear outriggers are each in their respective deployed positions.
Figure 2D:
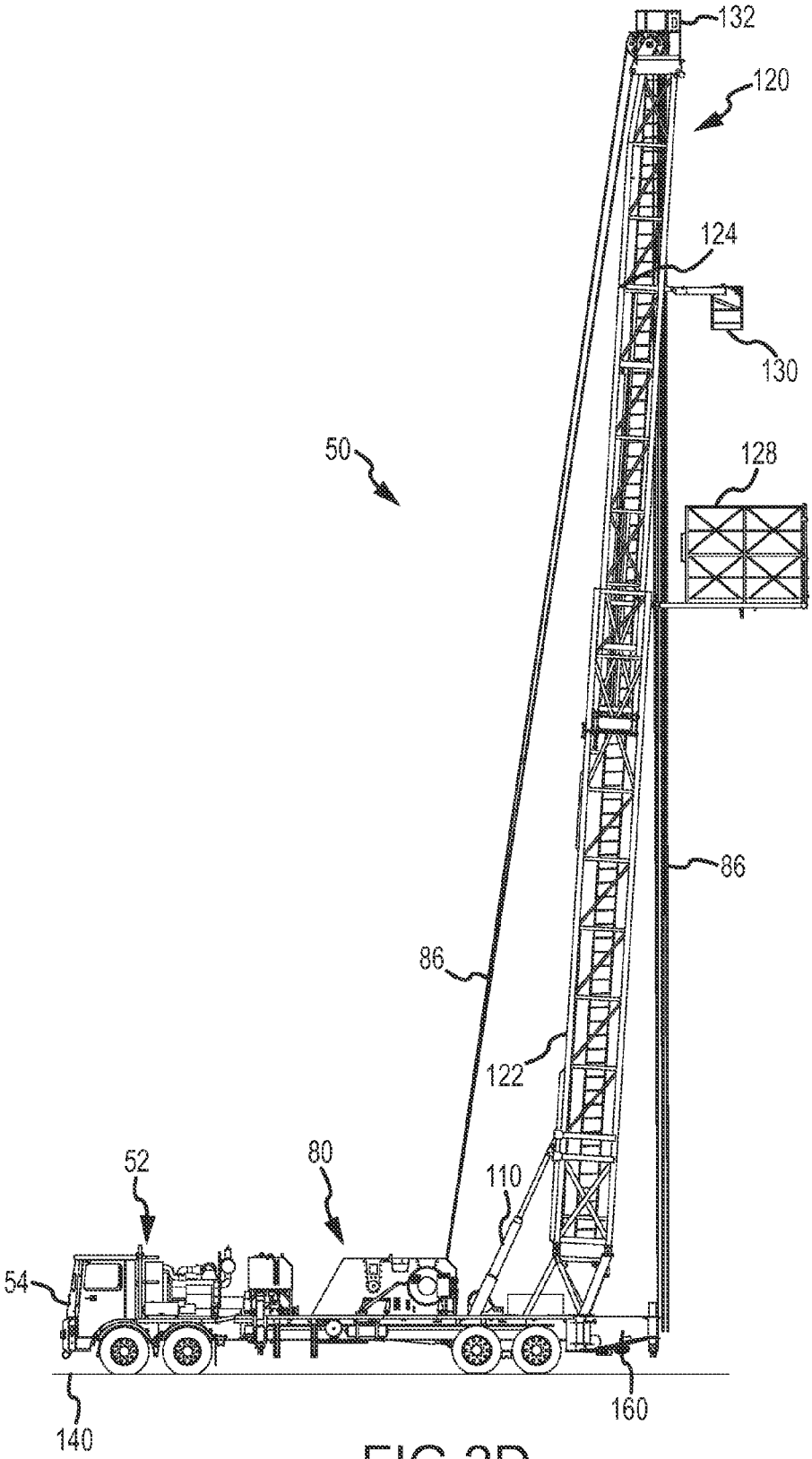
FIG. 2D is a side view of the guyless service rig in the FIG. 2B/2C configuration.
Figure 3:
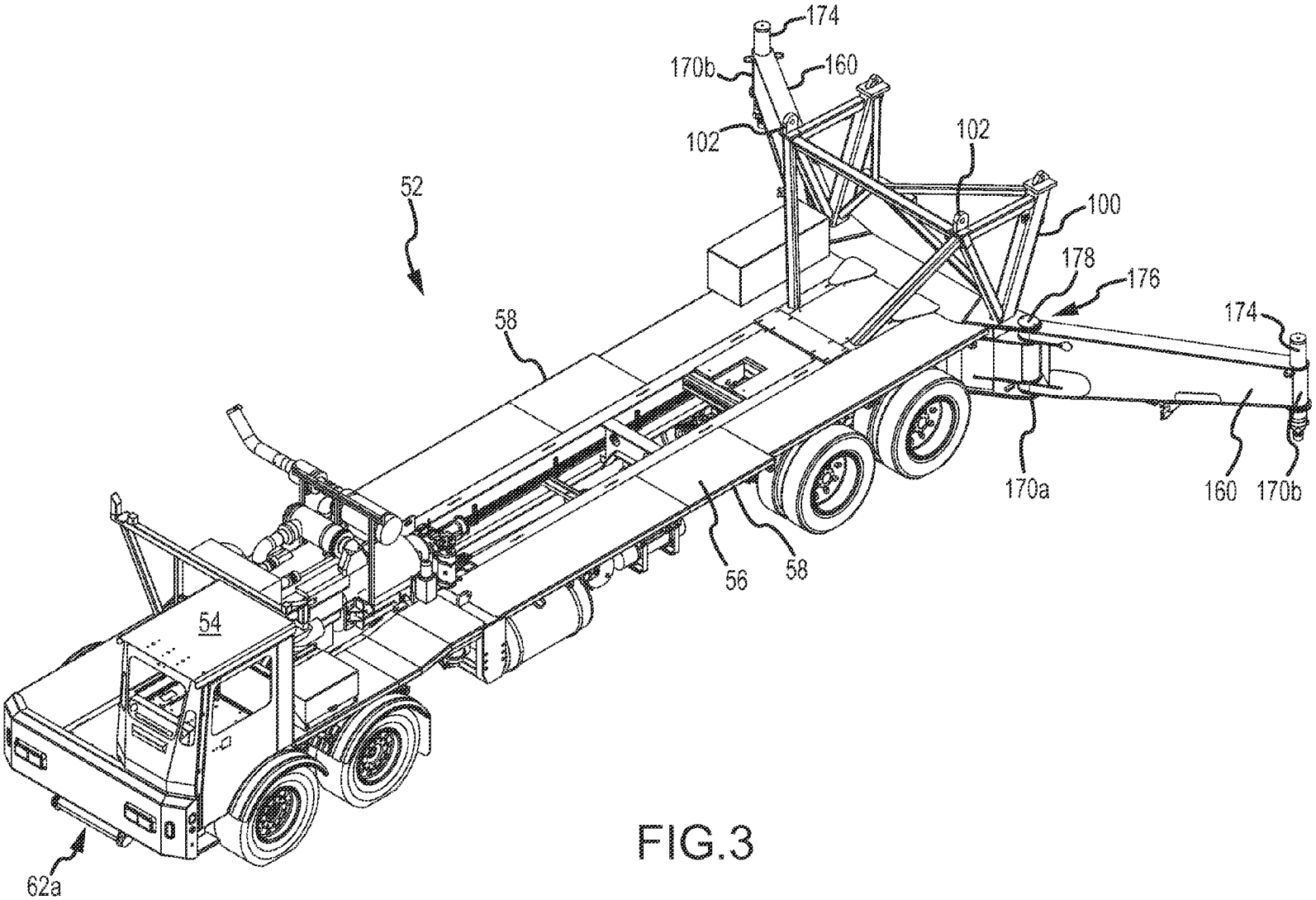
FIG. 3 is a perspective view of the guyless service rig of FIG. 2A with the mast removed therefrom, and with the rear outriggers being in the deployed position.
Figure 5A:
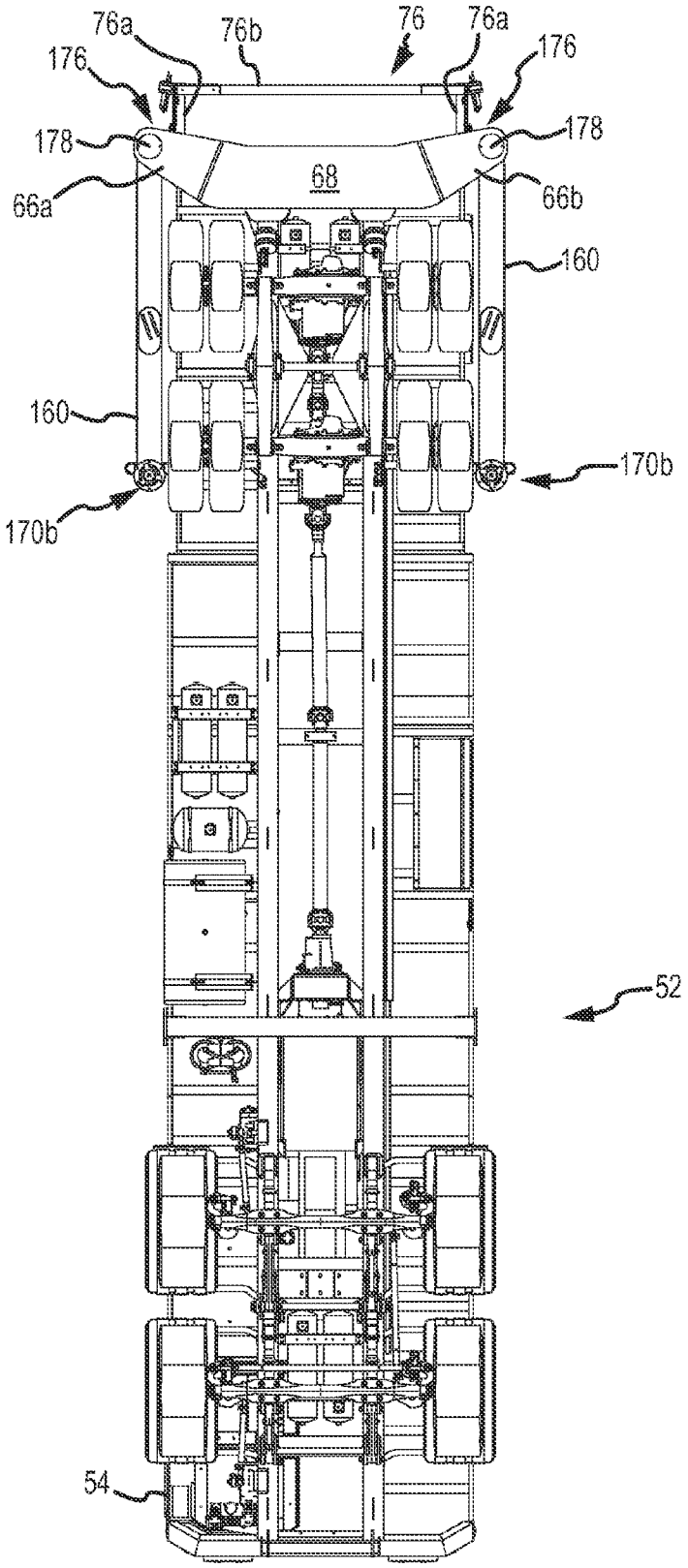
FIG. 5A is a bottom view of the guyless service rig of FIG. 2A, with the rear outriggers being in the transport position.
Figure 5B:
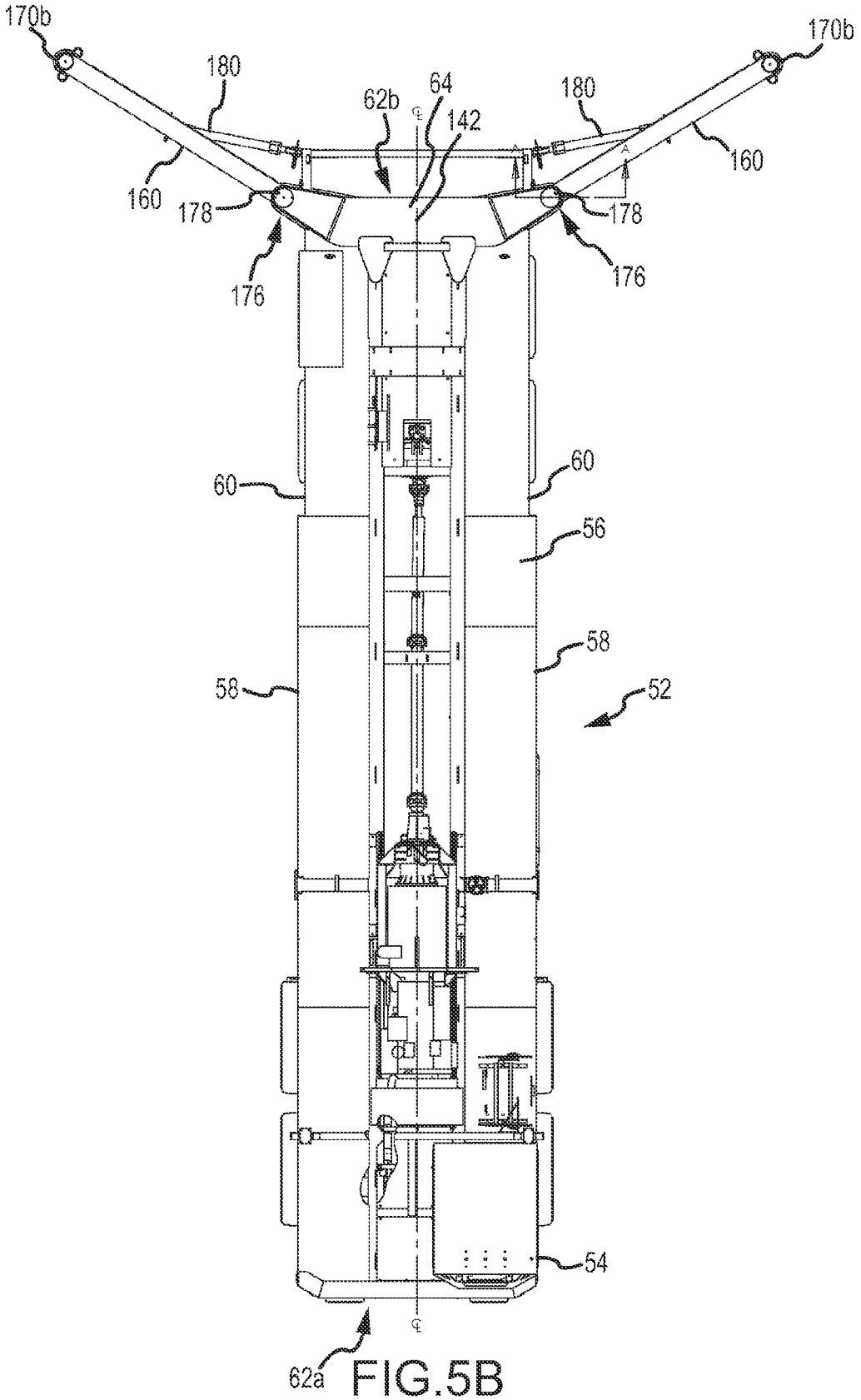
FIG. 5B is a top view of the guyless service rig of FIG. 2A with the mast and Y-base removed therefrom, and with the rear outriggers being in the deployed position.

The service rig 50 is configured to eliminate the need for guy wires or lines to stabilize the mast 120 in its deployed position (where the mast 120 is at least generally upright and fully extended position, as illustrated in FIGS. 2B-2D). The carrier bed 56 includes two carrier sides 58 that are spaced in the lateral dimension. The lateral dimension corresponds with the width of the carrier bed 56 (e.g., parallel to a lateral reference axis 146 shown in FIG. 5C and discussed below). The lateral dimension is also orthogonal to the length dimension of the carrier bed 56 which corresponds with the length dimension of the mast 120 in its transport position. Such a length dimension coincides with the central longitudinal axis 142 of the service rig 50/carrier 52 shown in FIG. 5B-5D and discussed in more detail below.

One forward outrigger 150 is positioned on each carrier side 58, and includes a jack 152 of any appropriate type which may be extended/retracted on any appropriate basis (e.g., manually, hydraulically). The forward outriggers 150 may be disposed at any appropriate location along the length dimension of the carrier bed 56, but will typically be positioned on the forward half of the carrier 52 (e.g., somewhere between the middle of the carrier 52 (half-way between its forward end 62*a* and its rear end 62*b*)). The forward outriggers 150 may telescope out from the corresponding carrier side 58 (e.g., along an axis that is orthogonal to the central longitudinal axis 140). The workover rig 50 further includes two rear outriggers 160 that are located toward the rear end 62*b* of the carrier 52. A jack 174 of any appropriate type is provided for each rear outrigger 160 (e.g., at or toward its free end 170*b*). Each such jack 174 may be extended/retracted on any appropriate basis (e.g., manually, hydraulically).

Figure 4A:
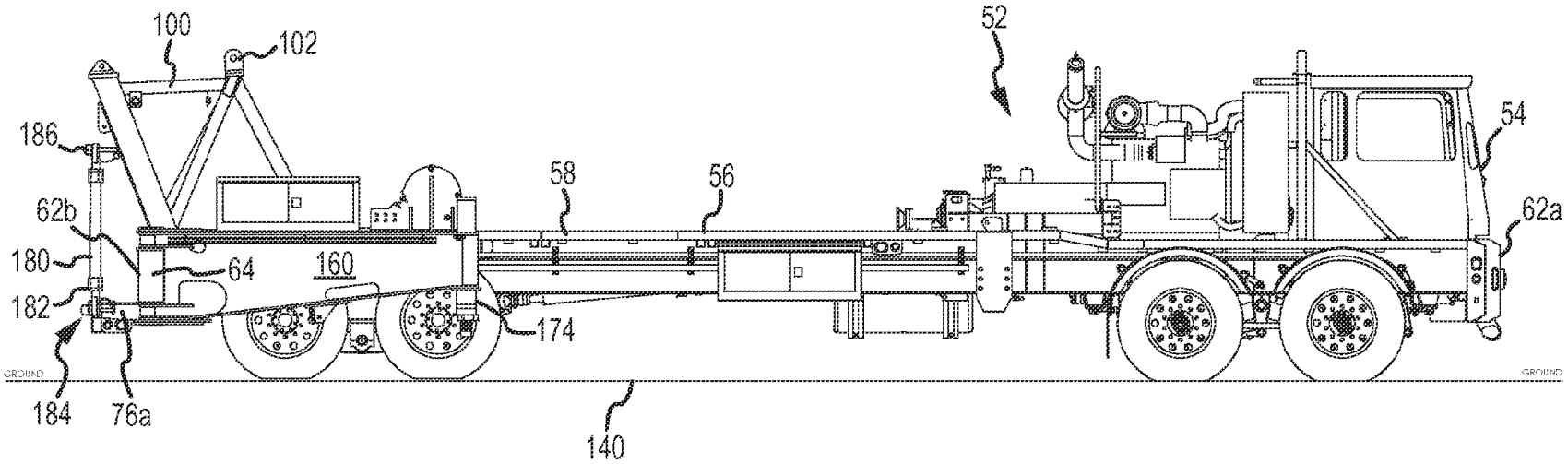
FIG. 4A is a side view of the guyless service rig of FIG. 2A with the mast removed therefrom, and with the rear outriggers being in the transport position.
Figure 4B:
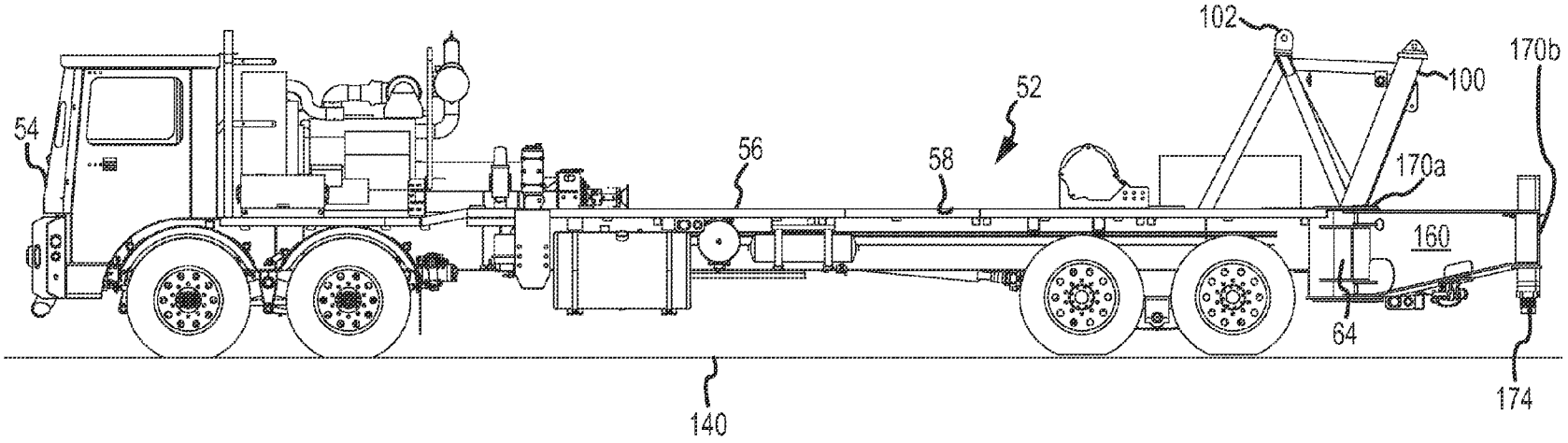
FIG. 4B is a side view of the guyless service rig of FIG. 2A with the mast removed therefrom, and with the rear outriggers being in the deployed position.

The rear outriggers 160 are movable between a transport or stowed position, and a deployed or extended position. These two positions are collectively shown in FIGS. 4A, 4B, 5A, 5B, 6A, and 6B, along with FIGS. 2A-2D. Each rear outrigger 160 is positioned along a corresponding carrier side 58 of the carrier bed 56 in its transport or stowed position (e.g., FIGS. 2A, 4A, and 5A), with a free end 170*b* of each rear outrigger 160 being positioned forwardly of a corresponding pivotal end 170*a* of the rear outrigger 160. In this regard, the carrier bed 56 includes a rear outrigger cutout or notch 60 on each of its two carrier sides 58. Each cutout 60 extends from the rear end 62*b* along the length of the carrier bed 56 a sufficient distance so as to be able to receive its corresponding rear outrigger 160 in its stowed or transport position.

Each rear outrigger 160 extends at least generally away from its corresponding carrier side 58 (and also at least generally away from the central longitudinal axis 142 of the service rig 50/carrier 52) and also rearwardly of the rear end 62*b* of the carrier 52 when in the deployed or extended position (FIGS. 2B-2D, 3, 4B, 5B, 6A, and 6B). The length of the rear outriggers 160 and their angled position provide a desired degree of stability for the service rig 50 when performing servicing/workover operations.

Figure 5C:
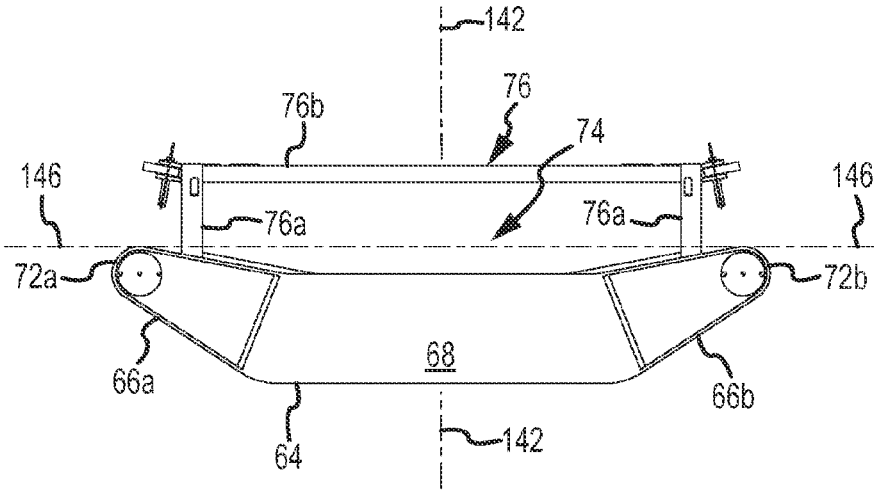
FIG. 5C is an enlarged bottom view of the carrier bumper and rear outrigger brace frame of the guyless service rig of FIG. 2A.
Figure 5D:
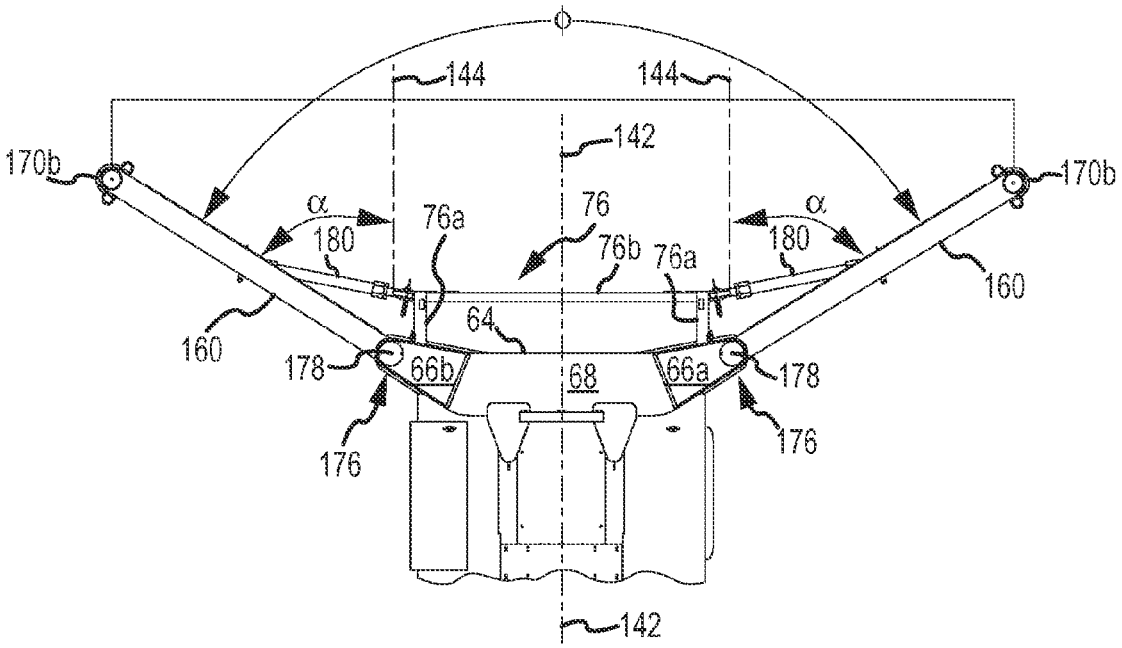
FIG. 5D is an enlarged top view of rear portion of the guyless service rig of FIG. 2A, with the rear outriggers being in the deployed position.
Figure 6A:
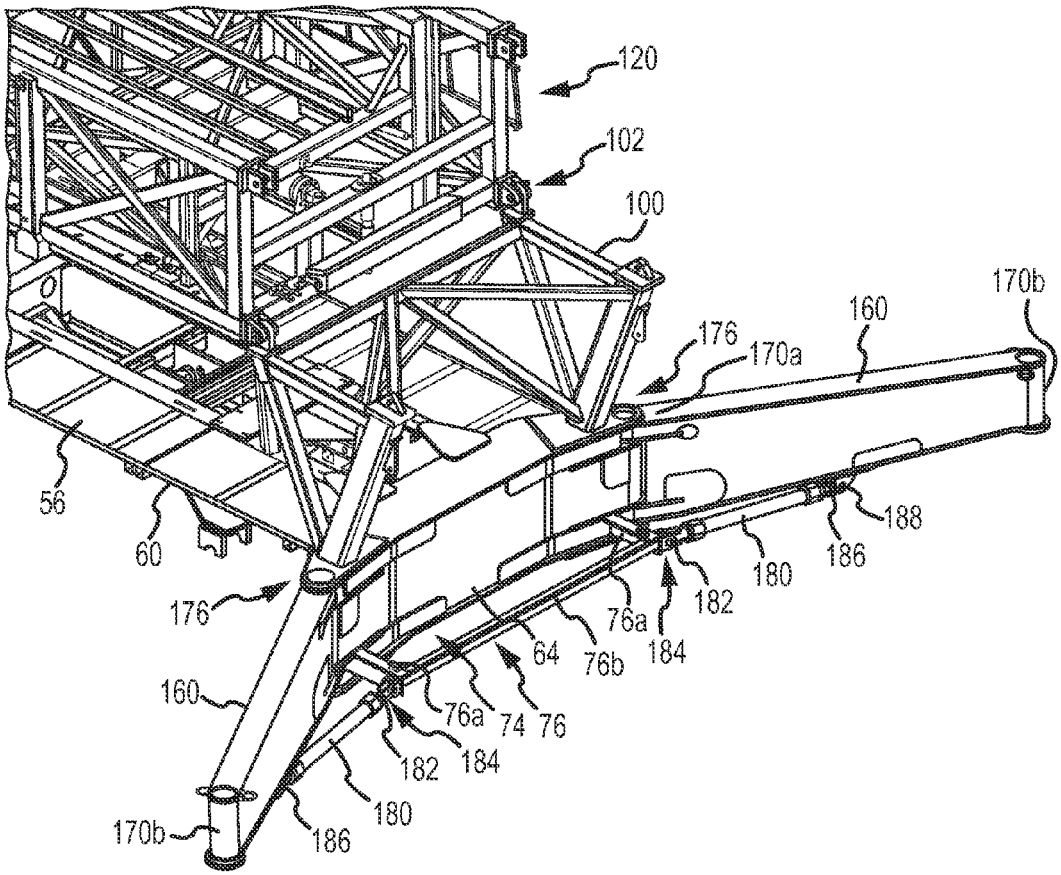
FIG. 6A is a rear, perspective view of the guyless service rig of FIG. 2A, where the rear outriggers are in the deployed position.
Figure 6B:
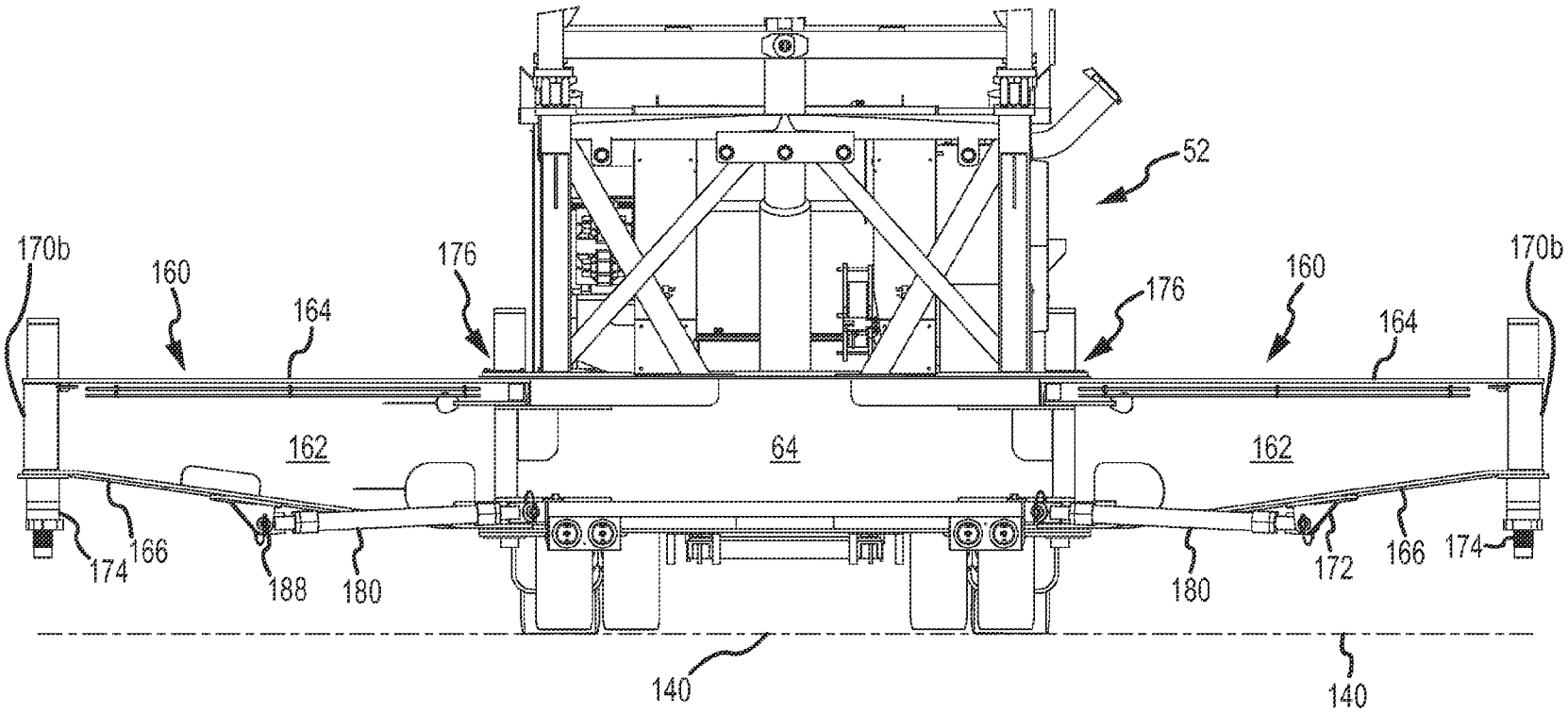
FIG. 6B is a rear view of the guyless service rig of FIG. 2A, where the rear outriggers are in the deployed position.

In their deployed position and as illustrated in FIG. 5D, an included angle $\alpha$ exists between each rear outrigger 160 and a corresponding longitudinal reference axis 144, where this longitudinal reference axis is parallel to the central longitudinal axis 142 of the service rig 50/carrier 52, and furthermore extends through a pivotal connection 176 between the corresponding rear outrigger 160 and the carrier bumper 64. Generally, the magnitude of each included angle $\alpha$ is less than 90°. In one embodiment, each included angle $\alpha$ is within a range of about 53° to about 63°. An included angle $\theta$ also exists between the two rear outriggers 160 in their deployed position, which is also illustrated in FIG. 5D. Generally, the magnitude of this included angle $\theta$ is less than 180°. In one embodiment, the included angle $\theta$ is within a range of about 116° to about 126°.

The rear outriggers 160 again are movably interconnected with the carrier 52, more specifically with the bumper 64 on its rear end 62*b*. Referring now at least to FIGS. 6A-B and 7A-D, an outrigger/carrier pivotal connection 176 exists between each rear outrigger 160 and the carrier bumper 64. As the rear outriggers 160 are of a common configuration, only one need be described herein. The rear outrigger 160 includes a pivotal end 170*a* and a free end 170*b*. The pivotal end 170*a* may be in the form of a tongue that may be directed into an appropriately-shaped receiver or cavity on the carrier bumper 64, but in any case is that portion of the rear outrigger 160 that is movably connected with the carrier bumper 64. One or more outrigger/carrier pivot pins 178 extend into/through at least part of the carrier bumper 64 and into/through the pivotal end 170*a* of the rear outrigger 160 in the illustrated embodiment. Each outrigger/carrier pivot pin 178 is at least substantially vertically disposed when the carrier 52/carrier bed 56 is at least substantially horizontally disposed (e.g., when the service rig 50 is positioned on flat ground).

Based upon the foregoing, the manner in which the rear outriggers 160 may be deployed is subject to a number of characterizations. One is that the rear outriggers 160 may move (e.g., pivot) at least substantially within a common plane when moving between their corresponding transport and deployed/extended positions. Each of the individual rear outriggers 160 may be characterized as moving (e.g., pivoting) within a plane that is at least substantially parallel to the carrier bed 56 when moving between their corresponding transport and deployed/extended positions. The rear outriggers 160 may move (e.g., pivot) at least substantially in a horizontal manner or fashion when the carrier 52 is in a horizontal position. Consider the case where the carrier 52 is positioned on flat ground (and which may be characterized as coinciding with a reference plane 140 that is tangent to the contact between the tires of the carrier 52 and the ground). Each of the individual rear outriggers 160 may move (e.g., pivot) within a reference plane (and including in a common reference plane) that is parallel to the ground in this instance.

The rear outriggers 160 are movably interconnected with the carrier 52, more specifically with the carrier bumper 64 on its rear end 62*b*. Although the rear outriggers 160 and carrier bumper 64 are shown in various of the figures, FIGS. 5C and 5D present enlarged views of a rear portion of the service rig 50, and including the carrier bumper 64. Initially and in a top view, the carrier bumper 64 may be characterized as being at least generally arcuately-shaped, with a cavity defined by this arcuate shape opening or projecting in a rearward direction. Stated another way, a rearward-most portion of the carrier bumper 64 may be characterized as being at least generally concave.

The carrier bumper 64 includes a pair of end sections 66*a*, 66*b* and an intermediate section 68 that extends therebetween. Generally, the end sections 66*a*, 66*b* of the carrier bumper 64 are disposed in a different orientation than the intermediate section 68, with the end sections 66*a* and 66*b* being the mirror image of each other in the illustrated embodiment. Specifically, the end sections 66*a*, 66*b* of the carrier bumper 64 each extend both rearwardly of the intermediate bumper section 68 and away from a central longitudinal axis 142 of the service rig 50/carrier 52. The intermediate bumper section 68 may be characterized as being at least primarily laterally extending (e.g. orthogonal to the central longitudinal axis 142), with each end section 66*a*, 66*b* extending both laterally and rearwardly from a corresponding portion of the intermediate bumper section 68.

Further characterizations may be made in relation to the carrier bumper 64. FIG. 5C shows a lateral reference axis 146 that is tangent to opposing ends 72*a*, 72*b* of the carrier bumper 64. The lateral reference axis 146 is orthogonal to the central longitudinal axis 142. As can be seen in FIG. 5C, this lateral reference axis 146 is spaced from the rearward-most portion of the intermediate section 68 of the carrier bumper 64. A space 74 exists between this lateral reference axis 146 and the rearward-most portion of the intermediate section 68 of the carrier bumper 64. The noted outrigger/carrier pivotal connections 176 may be provided on each of the bumper end sections 66*a*, 66*b*.

The entirety of each rear outrigger 160 may be characterized as being an at least generally horizontally disposed or extending structure. In one embodiment, no portion of either rear outrigger 160 extends above the carrier bed 56. In any case and referring now at least primarily to FIGS. 6A-B and 7A-D, each rear outrigger 160 may be in the form of a hollow beam or beam-like structure. Each rear outrigger 160 includes an upper or top wall 164, a lower or bottom wall 166 that is spaced from the upper wall 164, and a pair of side walls 162. The top wall 164 and bottom wall 166 may be characterized as being spaced in the vertical dimension, while the side walls 162 they be characterized as being spaced in a lateral dimension for the rear outriggers 160 (the lateral dimension of the outriggers 160 being orthogonal to the length dimension for the rear outriggers 160, where this length dimension coincides with the spacing between their corresponding ends 170*a*, 170*b*). The top wall 164, bottom wall 166, and side walls 162 are appropriately joined together (e.g., welding, fasteners, or both) to collectively define an inner cavity or space 168. This provides the hollow configuration for the rear outriggers 160.

Figure 7A:
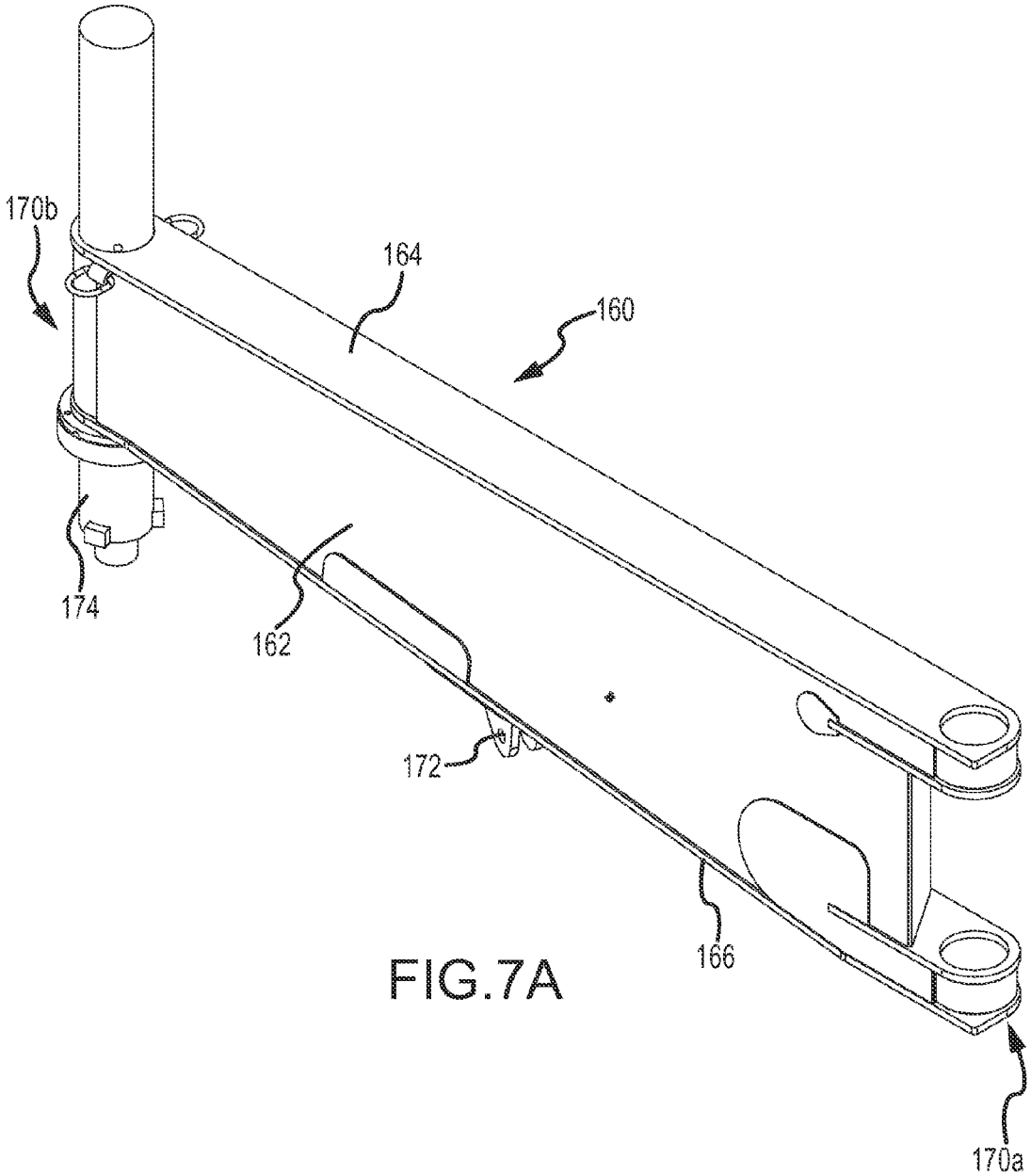
FIG. 7A is a perspective view of one of the rear outriggers from the guyless service rig of FIG. 2A.
Figure 7B:
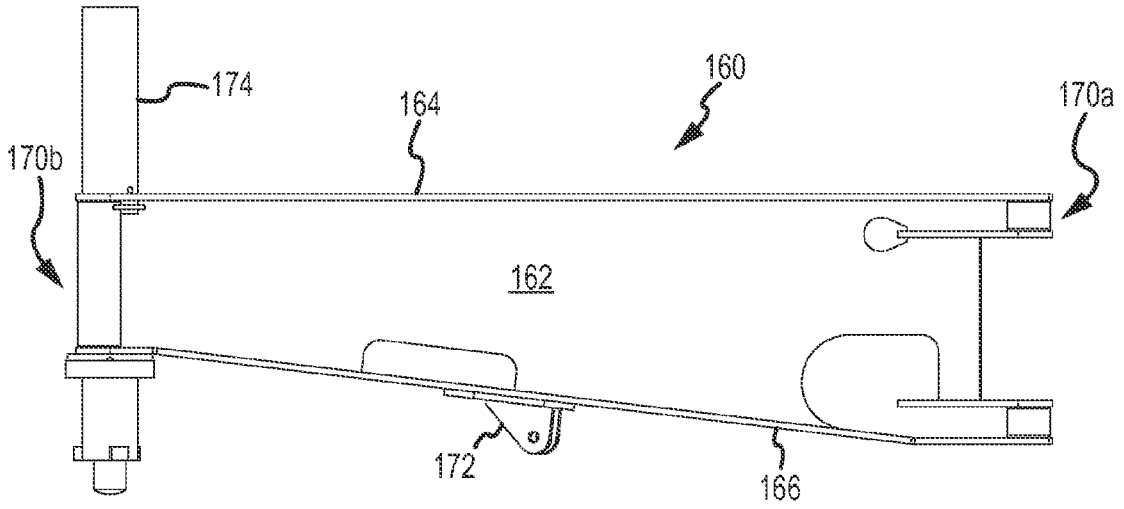
FIG. 7B is a side view of the rear outrigger of FIG. 7A.
Figure 7C:
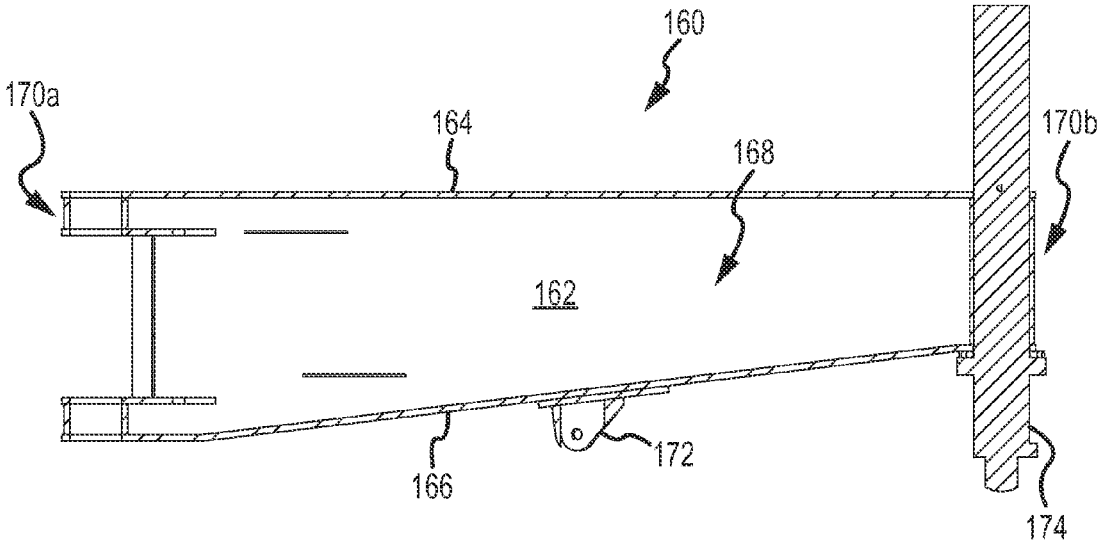
FIG. 7C is a cross-sectional view of the rear outrigger of FIG. 7A, taken along its length dimension.
Figure 7D:
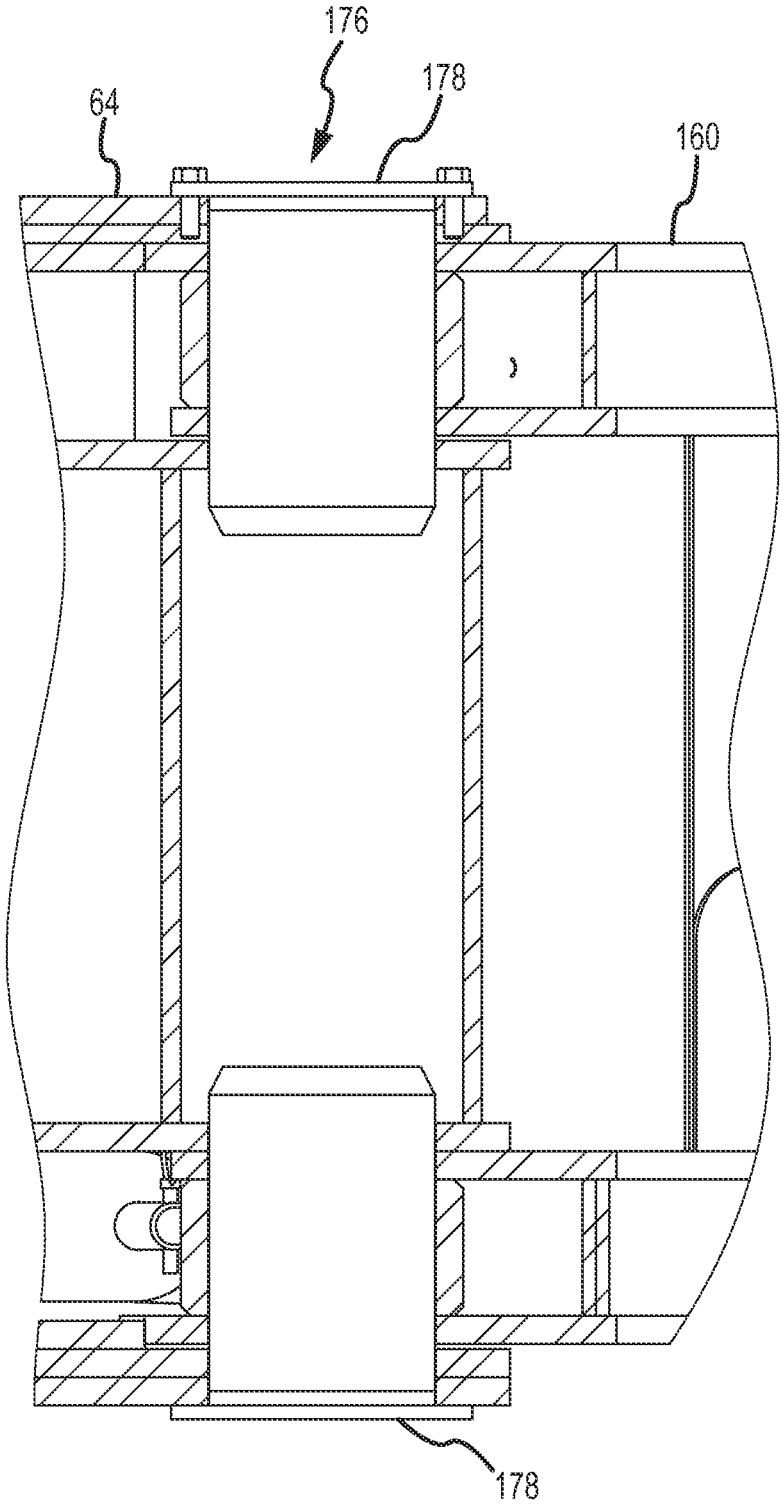
FIG. 7D is a cross-section view that illustrates the pivotal connection between the carrier bumper and one of the rear outriggers of the guyless service rig of FIG. 2A.

At least part of the rear outriggers 160 may have a tapering height proceeding along their respective lengths, for instance as shown in FIGS. 7B and 7C. Consider the case where the service rig 50 is positioned on flat ground and that the flat ground corresponds/coincides with a horizontal dimension. The top wall 164 of the rear outriggers 160 may be horizontally disposed (e.g., parallel with the underlying ground), while the bottom wall 166 may proceed at least generally toward the top wall 164 proceeding from its corresponding pivotal end 170*a* to its corresponding free end 170*b*. This "tapering" configuration for the rear outriggers 160 provides a clearance for the outriggers 160 when moving the same from the transport position to the deployed or extended position (e.g., reduces the potential for the underlying ground impeding the deployment of the rear outriggers 160). Other advantages of this configuration include reducing the weight of the rear outriggers 160.

The rear outriggers 160 may be locked in the transport position in any appropriate manner (e.g., via one or more locking pins), and may also be locked in the deployed/extended position. In this second instance, each rear outrigger 160 includes a rear outrigger brace receiver or bracket 172 on its bottom wall 166. Two outrigger braces or turnbuckles 180 are appropriately interconnected with and positioned rearwardly of the carrier bumper 64. Although the outrigger braces 180 could be movably mounted directly with the carrier bumper 64, in the illustrated embodiment an outrigger brace frame 76 is appropriately mounted to and extends rearwardly of the carrier bumper 64. This outrigger brace frame 76 includes two end sections 76*a* that are appropriately attached to the carrier bumper 64 and extend rearwardly therefrom. An intermediate section 76*b* of the outrigger brace frame 76 extends between these two end sections 76*a*.

A pivotal connection 184 exists between a carrier end 182 of each outrigger brace 180 and the outrigger brace frame 76 (e.g., to allow each outrigger brace 180 to move or pivot between a transport and deployed or outrigger locking position). An opposite end of each outrigger brace 180 (an outrigger end 186) is detachably connectable with its corresponding rear outrigger 160 when in its deployed/extended position, and which at least substantially fixes the position of this rear outrigger 160 relative to the carrier 52.

The rear outrigger braces 180 may be characterized as being located in the space between the deployed rear outriggers 160. When the rear outriggers 160 are in their deployed position, the rear outrigger braces 180 may be characterized as being located in the above-noted included angle θ between the rear outriggers 160. In one embodiment, each of the pivotal connections 184 for the outrigger braces 180 is located somewhere between the rear outrigger/carrier pivotal connections 176 in the lateral dimension. In one embodiment, each of the pivotal connections 184 for the outrigger braces 180 is located further rearwardly in the longitudinal dimension than each of the rear outrigger/carrier pivotal connections 176.

Each rear outrigger brace 180 is movable between a stowed or transport position and a deployed or rear outrigger locking position. The outrigger braces 180 may be at least generally vertically extending when in the stowed or transport position (e.g., FIG. 4A), and furthermore may be locked in this position in any appropriate manner. After any required unlocking of the outrigger braces 180, each outrigger brace 180 may be independently moved to its deployed or outrigger locking position (e.g., where each rear outrigger brace 180 may be at least generally horizontally disposed, although each rear outrigger brace 180 may extend at least slightly downwardly progressing in the direction of its corresponding outrigger end 186). Once a rear outrigger 160 and its corresponding outrigger brace 180 are each in their respective deployed or extended positions, the outrigger brace 180 may be detachably coupled with its corresponding rear outrigger 160 (e.g., via a locking pin 188, shown in FIGS. 6A and 6B). It may be beneficial for each outrigger brace 180 to utilize a turnbuckle configuration to allow its length to be adjusted to facilitate its detachable connection with its corresponding rear outrigger 160 (e.g., to accommodate for the effect of temperature changes). In one embodiment, each outrigger brace 180 is detachably coupled with its corresponding rear outrigger 160 about ½ way between its corresponding pivotal end 170*a* and its corresponding free end 170*b*.

Each rear outrigger 160 and its corresponding outrigger brace 180 are independently movable. Moving a rear outrigger 160 from its transport position to its deployed or extended position does not in itself cause its corresponding rear outrigger brace 180 to move from its transport position to its deployed or extended position, or vice versa. A rear outrigger 160 may be characterized as moving within a first dimension when moving between its transport and deployed/extended positions, and its corresponding outrigger brace 180 may be characterized as moving within a different second dimension when moving between its transport and deployed/extended positions. In one embodiment, the second dimension in which an outrigger brace 180 may move is at least generally orthogonal to the first dimension in which its corresponding outrigger brace 160 may move.

Various lines may extend from the mast 120 and may be anchored to various structures. In the illustrated embodiment, none of these lines extend to the ground—the workover rig 50 may therefore be characterized as a guyless workover rig 50. As noted above, stabilizing a deployed mast of a service rig can be a very time consuming operation. One or more bumper lines (not shown) may extend from the crown 132 of the mast 120 to the carrier bed 56 (e.g., to a location at least generally proximate to the location of the forward outriggers 150). One or more lines may extend from the mast 120 to each of the rear outriggers 160. For instance a separate board line 90 may extend from the racking/tubing board 128 to each rear outrigger 160 (only shown for one rear outrigger 160 in FIG. 2C).

The service rig 50 is of an advantageous design. The spacing between the rear outriggers 160 in their transport position (e.g., FIG. 2A) allows the service rig 50 to be used on public highways. Another benefit is the alleviation of the need for any guy lines or wires to stabilize its mast 120 in the deployed and fully extended position. No complex linkage or linkages exist between the rear outriggers 160 and the carrier 52. A single movable coupling exists between each rear outrigger 160 and the carrier bumper 64—a pivotal joint in the form of the above-noted outrigger/carrier pivotal connections 176. Moreover, each rear outrigger 160 may be unlocked from the carrier 52 when in its transport position, and may be manually moved to its deployed or extended position (e.g., FIG. 2B). Its corresponding rear outrigger brace 180 may be unlocked (as required) and separately moved to its deployed position, at which time each rear outrigger brace 180 may be detachably coupled with its corresponding rear outrigger 160 in any appropriate manner (e.g., using a locking pin 188). The noted operations may be reversed to move each rear outrigger 160 and their corresponding rear outrigger brace 180 back to their respective transport positions.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A mobile service rig, comprising:

a carrier comprising a plurality of tires, first and second carrier sides, a forward end, and a rear end, wherein a length dimension of said carrier extends along a central longitudinal axis that in turn extends between said forward end and said rear end of said carrier, wherein said forward end and said rear end are spaced from each other in a direction of travel of said carrier accommodated by said plurality of tires, and wherein each of said first and second carrier sides also extends between said forward end and said rear end;

a drawworks mounted on said carrier and comprising a main drum;

a mast movably mounted to said carrier and movable between a mast transport position and a mast deployed position, wherein said mast is prone relative to said carrier when in said mast transport position, wherein said mast is upstanding relative to said carrier when in said mast deployed position, wherein said mast comprises first and second mast sections that telescope relative to each other, and wherein a length dimension of said mast in said mast transport position coincides with said length dimension of said carrier;

at least one anchoring line comprising first and second anchoring lines, wherein opposite ends of each anchoring line used by said mobile service rig is anchored solely to said mobile service rig;

first and second rear outriggers that are pivotally connected with said carrier by first and second pivotal connections, respectively, wherein one end of said first anchoring line is anchored to said first rear outrigger, and wherein one end of said second anchoring line is anchored to said second rear outrigger;

an outrigger transport position for each of said first and second rear outriggers; and an outrigger deployed position for each of said first and second rear outriggers, wherein each of said first and second rear outriggers are pivotable relative to said carrier between said outrigger transport position and said outrigger deployed position;

wherein when said first and second rear outriggers are in said outrigger transport position: a) said first rear outrigger extends alongside said first carrier side from said first pivotal connection with said carrier in a direction of said forward end of said carrier and terminates at a first free end of said first rear outrigger such that said first free end of said first rear outrigger is positioned forward of said first pivotal connection with said carrier and such that said first free end of said first rear outrigger and said first pivotal connection are disposed at different longitudinal locations relative to said central longitudinal axis; and b) said second rear outrigger extends alongside said second carrier side from said second pivotal connection with said carrier in a direction of said forward end of said carrier and terminates at a second free end of said second rear outrigger such that said second free end of said second rear outrigger is positioned forward of said second pivotal connection with said carrier and such that said second free end of said second rear outrigger and said second pivotal connection are disposed at different longitudinal locations relative to said central longitudinal axis;

wherein when said first and second rear outriggers are in said outrigger deployed position: a) said first and second rear outriggers extend from said first and second pivotal connections, respectively, in a direction that is away from said first and second carrier sides, respectively, that is away from said forward end of said carrier, and that is rearwardly of said rear end of said carrier; b) said first free end of said first rear outrigger is rearward of each of said forward end of said carrier, said first pivotal connection with said carrier, and said rear end of said carrier; c) said second free end of said second rear outrigger is rearward of each of said forward end of said carrier, said second pivotal connection with said carrier, and said rear end of said carrier; d) an included angle between said first rear outrigger and a first reference axis, that is parallel to said central longitudinal axis and that extends through said first pivotal connection with said carrier, is less than 90° and is measured from a portion of said first reference axis that is rearward of said first pivotal connection; and e) an included angle between said second rear outrigger and a second reference axis, that is parallel to said central longitudinal axis and that extends through said second pivotal connection with said carrier, is less than 90° and is measured from a portion of said second reference axis that is rearward of said second pivotal connection;

wherein said first free end of said first rear outrigger pivots through an angle of more than 90° in changing from said outrigger transport position to said outrigger deployed position; and wherein said second free end of said second rear outrigger pivots through an angle of more than 90° in changing from said outrigger transport position to said outrigger deployed position.

2. The mobile service rig of claim 1, wherein said first and second rear outriggers are not directly coupled with said mast.

3. The mobile service rig of claim 1, wherein there are no movable joints of any kind between said mast and said first rear outrigger, and wherein there are no movable joints of any kind between said mast and said second rear outrigger.

4. The mobile service rig of claim 1, wherein there is a single coupling that allows said first rear outrigger to move between said outrigger transport position and said outrigger deployed position and which is between said first rear outrigger and said carrier, and wherein there is a single coupling that allows said second rear outrigger to move between said outrigger transport position and said outrigger deployed position and which is between said second rear outrigger and said carrier.

5. The mobile service rig of claim 1, wherein said carrier further comprises a bumper on said rear end of said carrier, wherein said first and second rear outriggers are each pivotally connected with said bumper.

6. The mobile service rig of claim 5, wherein said mobile service rig further comprises first and second pivot pins between said bumper and said first and second rear outriggers, respectively.

7. The mobile service rig of claim 6, wherein said first and second pivot pins are at least substantially vertically disposed when said carrier is at least substantially horizontally disposed.

8. The mobile service rig of claim 6, wherein a spacing between said first and second pivot pins defines a maximum width of said mobile service rig.

9. The mobile service rig of claim 5, further comprising a Y-base mounted on and extending above said bumper, wherein said mast is pivotally connected with said Y-base.

10. The mobile service rig of claim 1, wherein said mast comprises a crown that defines an uppermost portion of said mast when in said mast deployed position, and wherein said crown comprises at least one sheave.

11. The mobile service rig of claim 1, wherein said mast has a length so as to extend at least about 90 feet above a supporting surface, on which said mobile service rig is disposed, when in said mast deployed position.

12. The mobile service rig of claim 1, wherein having each said end of each said anchoring line being anchored solely to said mobile service rig provides a guyless mobile service rig.

13. The mobile service rig of claim 1, wherein said first and second rear outriggers pivot within a common plane when moving between said outrigger transport and outrigger deployed positions.

14. The mobile service rig of claim 1, wherein said carrier further comprises a bed, wherein said first and second rear outriggers each move within a plane that is parallel to said bed when moving between said outrigger transport and outrigger deployed positions.

15. The mobile service rig of claim 1, wherein said first and second rear outriggers move at least substantially in a horizontal dimension when said carrier is horizontally disposed and when moving said first and second rear outriggers between said outrigger transport and outrigger deployed positions.

16. The mobile service rig of claim 1, wherein a first reference plane corresponds with an interface between said plurality of tires and an underlying support surface on which said carrier is disposed, and wherein said first and second rear outriggers move parallel to said reference plane in moving between said outrigger transport and outrigger deployed positions.

17. The mobile service rig of claim 1, wherein each of said first and second rear outriggers is in the form of a hollow support beam.

18. The mobile service rig of claim 1, wherein said carrier further comprises a carrier bumper, and wherein said first and second rear outriggers are movably interconnected with a first end portion and a second end portion, respectively, of said carrier bumper that are oppositely disposed.

* * * * *